US006434344B1

(12) United States Patent
Yoshida et al.

(10) Patent No.: US 6,434,344 B1
(45) Date of Patent: Aug. 13, 2002

(54) IMAGE FORMING APPARATUS HAVING A TRANSFER DEVICE FOR TRANSFERRING A TONER IMAGE AND HAVING A BIAS VOLTAGE CONTROLLER

(75) Inventors: Minoru Yoshida, Machida; Masashi Takahashi, Yokohama, both of (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/794,635

(22) Filed: Feb. 28, 2001

(51) Int. Cl.[7] ..... G03G 15/00
(52) U.S. Cl. ..... 399/44
(58) Field of Search ..... 399/44, 45, 66, 399/308, 312, 297

(56) References Cited

U.S. PATENT DOCUMENTS

| | | | | |
|---|---|---|---|---|
| 5,233,393 A | | 8/1993 | Yoshida et al. | 355/271 |
| 5,469,248 A | | 11/1995 | Fujiwara et al. | 355/326 |
| 5,585,906 A | | 12/1996 | Takahashi et al. | 355/273 |
| 5,602,633 A | | 2/1997 | Yoshida et al. | 399/244 |
| 6,627,629 | | 5/1997 | Takahashi et al. | 399/231 |
| 5,678,150 A | | 10/1997 | Takahashi et al. | 399/299 |
| 5,729,788 A | * | 3/1998 | Hirohashi et al. | 399/66 |
| 5,732,314 A | * | 3/1998 | Tsukida et al. | 399/302 |
| 5,794,110 A | | 8/1998 | Kasai et al. | 399/299 |
| 6,044,236 A | * | 3/2000 | Katoh et al. | 399/101 |
| 6,070,024 A | * | 5/2000 | Oona | 399/66 |
| 6,198,899 B1 | | 3/2001 | Takahashi et al. | 399/303 |

FOREIGN PATENT DOCUMENTS

| | | | |
|---|---|---|---|
| JP | 62-24793 | | 5/1987 |
| JP | 2-39181 | * | 2/1990 |
| JP | 6-52446 | | 7/1994 |
| JP | 8-292658 | | 11/1996 |
| JP | 10-78712 | | 3/1998 |
| JP | 11-272098 | | 10/1999 |

OTHER PUBLICATIONS

U. S. patent application Ser. No. 09/725,944,Takahashi et al., preliminary class 399, filed Nov. 30, 2000.

* cited by examiner

*Primary Examiner*—Quana M. Grainger
(74) *Attorney, Agent, or Firm*—Foley & Lardner

(57) ABSTRACT

The image forming apparatus of the present invention, in which a toner image formed in an image forming section is transferred onto a transfer medium (sheet-like material) consisting of at least one of paper sheets and resin sheets, comprises a bias voltage supply for supplying a transfer bias voltage to a toner image transfer device, an environmental state detecting device for detecting at least one of temperature and humidity in the vicinity of the toner image forming section, and a bias voltage controller for switching the on/off state of the bias voltage output from the bias voltage supply as well as the magnitude and polarity of the bias voltage into a predetermined magnitude and polarity at a predetermined timing in accordance with the presence or absence of the transfer medium, the kind of the transfer medium and the environmental condition detected by the environmental state detecting device. The image forming apparatus of the particular construction permits transferring the toner image formed on the image carrier onto the sheet-like material with a high transfer efficiency without giving rise to the memory image by the transfer bias voltage.

14 Claims, 7 Drawing Sheets

IMAGE FORMING APPARATUS HAVING A TRANSFER DEVICE FOR TRANSFERRING A TONER IMAGE AND HAVING A BIAS VOLTAGE CONTROLLER

BACKGROUND OF THE INVENTION

The present invention relates to a transfer apparatus and a transfer method used in an image forming apparatus.

In an electrophotographic type copying apparatus or printer apparatus, a predetermined surface potential is imparted to a photosensitive body holding an electrostatic latent image so as to selectively change the surface potential of the photosensitive body corresponding to the background portion or the image portion, followed by supplying a toner (developing agent) to the surface of the photosensitive body so as to form a toner image (developing agent image) in the portion where the surface potential is selectively changed. The toner image thus formed is transferred onto a sheet-like material.

The toner image transferred onto the sheet-like material is melted and pressurized by a fixing apparatus so as to be fixed to the sheet-like material.

The method of transferring the toner image on the photosensitive body onto one surface of the sheet-like material can be roughly classified into a system of a non-contact type transfer bias voltage supply using, for example, a corona charger and another system of a contact transfer bias voltage supply using a roller, a brush, etc. In the case of using the contact type transfer bias voltage supply, it is possible to achieve a stable image transfer because the transfer bias voltage supply performs the function imparting a charge to the sheet-like material and the function of permitting the sheet-like material to be attached to the outer circumferential surface of the photosensitive body. Also, the system of using the contact type transfer bias voltage supply is advantageous over the system using the corona charger in that it is possible to suppress markedly the ozone generation.

Japanese Patent Publication (Kokoku) No. 62-24793 discloses a method of transferring a toner image from the photosensitive body onto a paper sheet while electrostatically holding the paper sheet on a transfer belt. Also, in the transfer system using a transfer belt, the paper sheet is held by the belt and, thus, the paper sheet is unlikely to be wound about the photosensitive body. Therefore the position of the paper sheet during transfer is unlikely to be changed. In other words, the pass of the paper sheet is stable. Under the circumstances, the transfer system using a transfer belt is absolutely required in the color image forming apparatus disclosed in, for example, Japanese Patent Publication No. 6-52446, in which four photosensitive bodies and four image forming sections for developing the latent image formed on the photosensitive bodies, which are for the four color components of yellow, magenta, cyan and black, respectively, are arranged in series.

The system using a transfer belt is also advantageous in a high speed printer or a high speed PPC having a high image forming capability for unit time in order to realize a stable transfer of a sheet-like material because the sheet-like material is unlikely to be wound about the photosensitive body. In this case, it is possible to ensure a stable transfer nip and to realize a good transfer by forming the transfer belt separately from the transfer bias voltage supply and by using a contact type transfer bias voltage supply as a device for imparting a transfer charge to the transfer belt.

On the other hand, in the case of using a contact type transfer bias voltage supply, it is desirable for the transfer bias voltage to be applied in only the case where the sheet-like material is present in the transfer nip. It should be noted in this connection, however, that it is unavoidable for the timing at which the sheet-like material arrives at the transfer nip to be changed by several milliseconds because of the nonuniformity of the transfer mechanism for transferring the sheet-like material. Under the circumstances, if the sheet-like material arrives at the transfer nip with a delay from the theoretic timing, the transfer bias voltage is applied before the sheet-like material arrives at the transfer nip and, thus, the transfer bias is applied directly to the photosensitive body, though the transfer bias should desirably be applied to the photosensitive body through the sheet-like material. As a result, a strong charge of a polarity opposite to the charging polarity is radiated to the photosensitive body. Since the photosensitive body is not sensitive to the charge of the opposite polarity in almost all the cases, the charge is not erased in the charge eliminating process using an erasing lamp. It follows that the image forming process proceeds to the subsequent charging step and the light exposure step while retaining the charge of the opposite polarity.

Because of the presence of the charge of the opposite polarity, the photosensitive body is not charged sufficiently to a predetermined potential in the charging process. Alternatively, the photosensitive characteristics in the particular portion are changed. As a result, only that portion of the photosensitive body which has directly received the transfer electric field exhibits a concentration differing from that in the other portion in the intermediate concentration image represented by a half tone, giving rise to an undesired image called a memory image by a transfer bias voltage so as to impair the uniformity of the image.

The memory image by the transfer bias voltage appears prominently in the transfer system using the contact type transfer bias voltage supply.

However, where the transfer bias voltage is applied to the inside of the sheet-like material within the region of the sheet-like material, if the sheet-like material enters the transfer nip earlier only slightly than the design value, the image is not transferred in the reading edge portion, giving rise to the problem that the image is not formed in the reading edge portion.

As described above, it is very difficult to suppress the occurrence of the memory image by the transfer bias voltage while lowering the failure to form the image in the reading edge portion of the sheet-like material. Incidentally, a method of eliminating the memory image by the transfer bias voltage, in which the charge of the opposite polarity received by the photosensitive body while the sheet-like material passes through the transfer nip is eliminated by applying an AC voltage from an AC corona charger, has already been put to a practical use. However, in order to arrange the AC corona charger for the charge elimination purpose, it is necessary for the photosensitive body to have a large outer diameter. Where the photosensitive body has an outer diameter smaller than about 40 mm, it is physically impossible to arrange the particular AC corona charger.

As described above, in the image forming apparatus employing a photosensitive body of a small diameter by using a transfer mechanism using a contact type transfer bias voltage supply or a transfer mechanism using a transfer belt and a contact type transfer bias voltage supply (roller body) in combination, it is difficult to satisfy both the complete elimination of the memory image by the transfer bias voltage and the elimination of the failure to form an image in the reading edge portion. Incidentally, the similar phenomenon also takes place in the trailing edge portion of the sheet-like material. If the image in the trailing edge portion of the sheet-like material is to be transferred, it is unavoidable for the timing of stopping the supply of the transfer bias voltage by the transfer bias supply device to be positioned outside the sheet-like material, giving rise to the problem that the surface potential of the photosensitive body is adversely affected (the surface potential of the photosensitive body is partially changed). In this case, if the distance between the adjacent sheet-like materials is larger than the length of one complete rotation of the photosensitive body (outer circumferential length of the photosensitive body), the surface potential of the photosensitive body is made substantially uniform by the steps of the charging and the charge elimination, with the result that the surface potential is brought back to the predetermined charging potential in the subsequent charging step. However, where the distance between the adjacent sheet-like materials is smaller than the outer circumferential length of the photosensitive body, the memory image by the transfer bias voltage is generated in the reading edge portion of the next image. It follows that, in the image forming apparatus in which the distance between the adjacent sheet-like materials is smaller than the outer circumferential length of the photosensitive body, it is impossible to prevent the failure of transfer in the trailing edge portion of the image while suppressing the generation of the memory image by the transfer bias voltage.

BRIEF SUMMARY OF THE INVENTION

An object of the present invention is to provide an image forming apparatus that permits suppressing the occurrence of a memory image by the transfer bias voltage while suppressing the failure to form an image in the tip end or both the tip end and the trailing edge portion when a continuous print out is obtained in an image forming apparatus in which the distance between the adjacent sheet-like materials is smaller than the outer circumferential length of the photosensitive body.

Another object of the present invention is to provide an image forming apparatus that permits suppressing the occurrence of a memory image by the transfer bias voltage while suppressing the failure to form an image in the tip end or both the tip end and the trailing edge portion in an image forming step applied to a sheet-like material having a narrow range of an appropriate value of the transfer bias voltage.

According to a first aspect of the present invention, there is provided an image forming apparatus, comprising an image forming section for forming a toner image on an image carrier; a transfer device that is brought into contact with the image carrier with a transfer medium interposed therebetween, the transfer medium including at least one of paper sheets and sheet-like resins, for transferring the toner image formed by the image forming section onto the transfer medium; a bias voltage supply for supplying a transfer bias voltage to the transfer device; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium.

According to a second aspect of the present invention, there is provided an image forming apparatus, comprising an image forming section for forming a toner image on an image carrier; a transfer device that is brought into contact with the image carrier with a transfer medium interposed therebetween, the transfer medium including at least one of paper sheets and sheet-like resins, for transferring the toner image formed by the image forming section onto the transfer medium; a bias voltage supply for supplying a transfer bias voltage to the transfer device; a device for changing the transfer interval of the transfer media for changing the timing of guiding the transfer media toward the image forming section; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium.

According to a third aspect of the present invention, there is provided an image forming apparatus, comprising an image forming section, including an image carrier, for forming a toner image on the image carrier; an image carrier rotating device for rotating the image carrier in the image forming section so as to move the outer circumferential surface of the image carrier at any of a first speed and a second speed lower than the first speed; a transfer device that is brought into contact with the image carrier with a transfer medium interposed therebetween, the transfer medium including at least one of paper sheets and sheet-like resins, for transferring the toner image formed on the image carrier in the image forming section onto the transfer medium; a transfer medium transfer device for transferring the transfer medium at any of a first speed equal to the speed at the outer circumferential speed of the image carrier and a second speed lower than the first speed; a speed changing device for changing the speed of each of the image carrier rotating device and the transfer medium transfer device to the second speed in forming a toner image on the sheet-like resin; a bias voltage supply for supplying a transfer bias voltage to the transfer device; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium.

Further, according to a fourth aspect of the present invention, there is provided an image forming apparatus, comprising an image forming section for forming a toner image on an image carrier; a transfer device that is brought into contact with the image carrier with a transfer medium interposed therebetween, the transfer medium including at least one of paper sheets and sheet-like resins, for transferring the toner image formed by the image forming section onto the transfer medium; a bias voltage supply for supplying a transfer bias voltage to the transfer device; an environmental state detecting device for detecting at least one of temperature and humidity in the vicinity of the image forming section; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium, the kind of the transfer medium and the environmental condition detected by the environmental state detecting device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 4A and 4B are a timing chart showing the timing for turning the transfer bias voltage on and the positional relationship of the memory image by the transfer bias voltage, and schematically show the memory image by the transfer bias voltage;

FIG. 4C is a timing chart for explaining another example of the timing of turning the transfer bias voltage on;

FIG. 4D is a timing chart for explaining the timing of turning the transfer bias voltage on as an example of the method of the present invention for controlling the bias voltage;

DETAILED DESCRIPTION OF THE INVENTION

An image forming apparatus of the present invention will now be described in detail with reference to the accompanying drawings.

Figure 1:
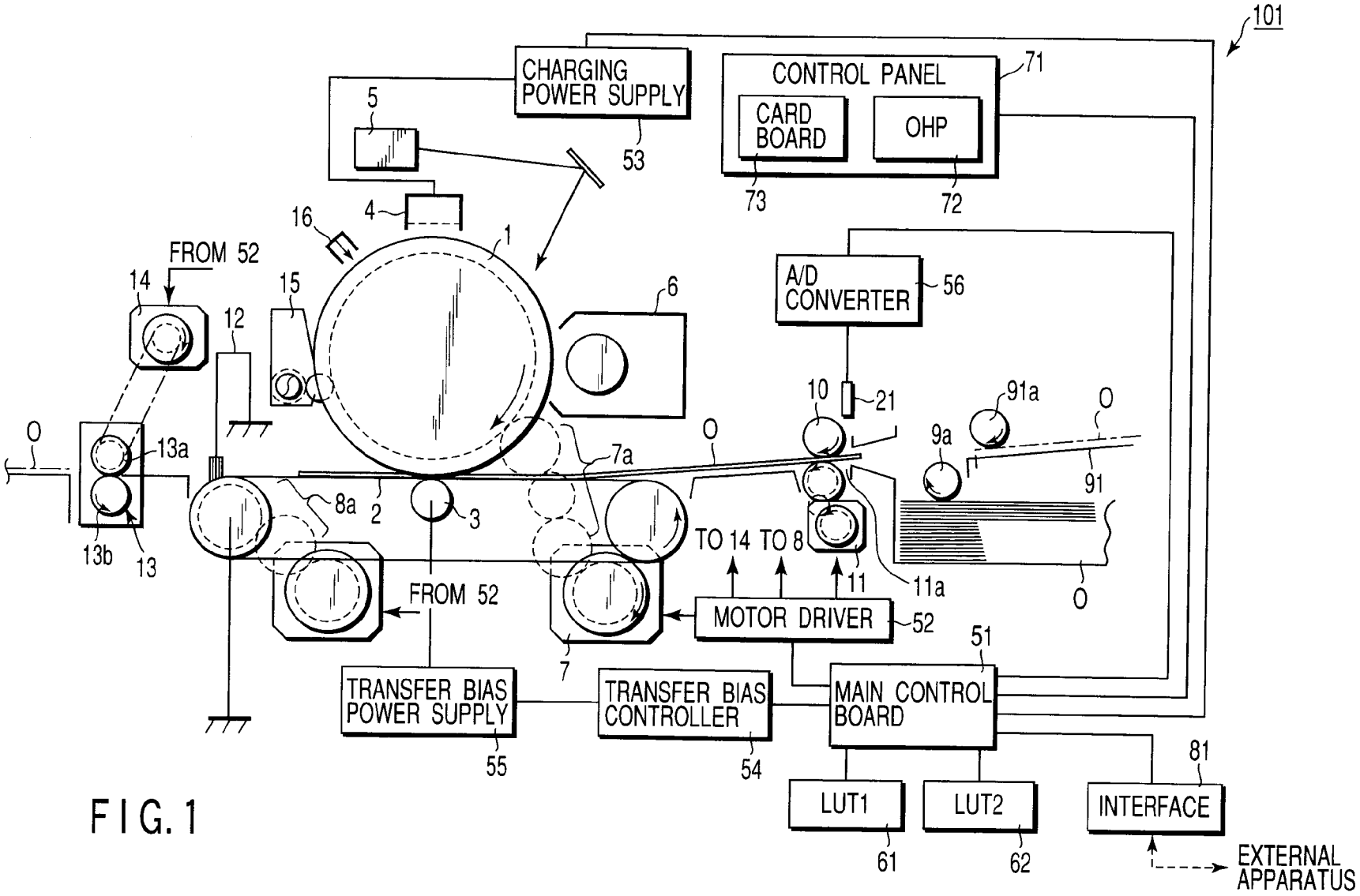
FIG. 1 schematically shows an example of an image forming apparatus in which the transfer mechanism and the transfer bias voltage control method of the present invention can be utilized.

FIG. 1 schematically shows a printer apparatus 101 as an example of the image forming apparatus of the present invention.

As shown in FIG. 1, the printer apparatus 101 comprises a photosensitive drum 1 for holding a latent image corresponding to the image to be output, a transfer belt 2 for transferring a paper sheet for printing out a toner image obtained by developing the latent image formed on the photosensitive drum 1 or for transferring a sheet-like material O, which is a transparent resin sheet for an OHP (Over Head Projector), and a transfer roller 3 for imparting pressure for bringing the sheet-like material O transferred via the transfer belt 2 into contact with the surface of the photosensitive drum 1 and for imparting a predetermined transfer bias voltage to the transfer belt 2. The photosensitive drum 1 is an OPC (Organic Photo-Conductor) drum having a diameter of 40 mm and imparted with a negative potential by a charging device 4.

The latent image is formed on the surface of the photosensitive drum 1 charged in the negative polarity by selectively irradiating the surface of the photosensitive drum 1 with a laser beam emitted from a light exposure device 5. Specifically, the negative charge on the photosensitive drum 1 is selectively eliminated, i.e., the surface potential is selectively made close to 0V, by the laser beam irradiation. As a result, a toner is selectively supplied to that portion alone by the reversal development performed by a two-component developing device 6 so as to form a toner image. Incidentally, the charging polarity of the toner is equal to the polarity of the potential that can be applied to the surface of the photosensitive drum 1.

The photosensitive drum 1 is rotated by a drum motor 7 via a column 7*a* of gears such that an optional point of the outer circumferential surface of the photosensitive drum 1 is rotated at a speed of, for example, 175 mm/sec (or at a speed of, for example, 120 mm/sec in relation to the thickness and the kind of the sheet-like material O). Incidentally, the rotating speed of the drum motor 7 is determined on the basis of the speed data stored in LUT1 (Look Up Table) 61 by specifying that the kind of the sheet-like material O is a transparent resin sheet for the OHP or by specifying that the kind of the sheet-like material O is a transparent resin sheet for the OHP on the basis of an OHP key 72 of a control panel 71 that can be input to a main control board 51 and an image data supplied from the outside through an interface 81.

The transfer belt 2 is stretched between a driving roller 2*a* and a driven roller 2*b*. If a belt motor 8 is rotated, the rotation is transmitted to the driving roller 2*a* via a column 8*a* of gears so as to be move the transfer belt 2 at a speed equal to the moving speed of outer circumferential surface of the photosensitive drum 1. Incidentally, tension springs (not shown) are mounted to both end portions of the driven roller 2*b*, with the result that a total of 2.1 kgf of tension is applied to both sides of the transfer belt 2.

For forming the transfer belt 2, it is possible to use, for example, a rubber material such as polyurethane rubber, ethylene-propylene copolymer resin (EPDM), or silicone rubber, or a resin material such as polycarbonate resin, polyimide resin, polyamide resin, or polyethylene terephthalate resin. In the printer apparatus 101 shown in FIG. 1, the transfer belt 2 is formed of a polycarbonate resin. Incidentally, an appropriate thickness of the transfer belt 2 falls within a range of between 60 $\mu$m and 250 $\mu$m. If the transfer belt 2 is unduly thin, the transfer belt 2 is likely to be broken, making it difficult to use the transfer belt 2 for a long time. On the other hand, if the transfer belt 2 is unduly thick, it is difficult to drive the transfer belt 2 smoothly.

Carbon is dispersed in the transfer belt 2 so as to impart a predetermined magnitude of resistance to the transfer belt 2. If the resistance value of the belt is unduly low, the mechanical strength of the belt is lowered by the presence of carbon. Also, carbon particles are liable to agglomerated so as to break down the transfer bias voltage. On the other hand, if the resistance value of the belt is unduly high, the magnitude of the transfer bias voltage is rendered high, compared with the ordinary transfer bias voltage, or the charge is accumulated in the belt. It follows that a charge eliminating device for eliminating the charge accumulated in the belt is required in order to prevent the transfer capacity from being lowered during the consecutive print out operation. Incidentally, in order to eliminate the charge accumulated in the belt, required is, for example, a corona charger for providing an AC corona charge. As a result, the manufacturing cost of the printer device is increased. In addition, ozone is generated in accordance with the AC corona charge. Such being the situation, the resistance value of the transfer belt, which permits maintaining the transfer capability without requiring the charge eliminating device, falls within a range of between $10^9$/cm and $10^{13}$/cm. In the printer apparatus shown in FIG. 1, used is a transfer belt having a resistance of $10^{11}$/cm.

The transfer roller 3 is prepared by forming a layer of a solid rubber such as polyurethane rubber, ethylene-propylene copolymer resin (EPDM), or silicone rubber or a foamed body thereof around a metal shaft. Also, it is possible to form a skin layer effective for improving the surface properties or the breakdown voltage characteristics on the surface of the solid rubber or the foamed body thereof, if necessary. In the printer apparatus shown in FIG. 1, the transfer roller 3 is prepared by forming a layer, having a thickness of 3 mm, of foamed polyurethane having carbon dispersed therein around a metal shaft having a diameter of 8 mm, with the result that the transfer roller 4 is a roller having an outer diameter of 14 mm.

It should be noted that a nip region, in which the transfer roller 3 is deformed in the region where the transfer roller 3 is pressed against the transfer belt 2, fails to be formed sufficiently depending on the hardness of the transfer roller 3. In order to obtain good transfer characteristics, it is desirable for the foamed body to have a hardness of 15 to 400 in ASKER-C scale. Incidentally, in the case of the roller made of a solid rubber or the roller having a skin layer formed on the surface, it is desirable for the transfer roller 3 to have a surface hardness of 20 to 45° in terms of the JIS-A scale.

An example of the image forming operation (print out operation) performed by the printer apparatus 101 will now be described.

Specifically, a drum motor driving signal is supplied from the motor driver 52 to the drum motor 7 on the basis of the control performed by the main control board 51 corresponding to the speed data set in accordance with the thickness and kind of the sheet-like material O and stored in the first LUT (LUT1) 61 so as to rotate the drum motor 7 at a predetermined speed. By the rotation of the drum motor 7, the photosensitive drum 1 is rotated in the direction denoted by an arrow via the gear column 7*a*. Also, the surface of the photosensitive drum 1 is charged uniformly at a potential of −500 to −800V by the charging device 4, which is, for example, a scrotron. The voltage that is to be output from the charging device 4 is set at a predetermined magnitude output from a charging power supply 53 that is set to supply a predetermined voltage to the charging device 4 under the control performed by the main control board 51.

Since the transfer belt 2 is in contact with the outer circumferential surface of the photosensitive drum 1 because of the pushing force generated from the transfer roller 3, a belt motor driving signal is generated from the motor driver 52 simultaneously with the rotation of the photosensitive drum 1 under the control performed by the main control board 51 in accordance with the speed date stored in the first LUT (LUT1) 61 so as to rotate the belt motor 8 at a predetermined speed. In accordance with the rotation of the belt motor 8, the driving roller 2*a* is rotated because of the rotation of the gear column 8*a* so as to move the transfer belt 2 at a speed equal to the moving speed of the outer circumferential surface of the photosensitive drum 1. Also, a transfer bias voltage of a predetermined magnitude and polarity is applied to the transfer roller 3 at a predetermined timing at which that region of the outer circumferential surface of the photosensitive drum 1 which is charged previously by the charging device 4 is guided to a transfer position at which the transfer roller 3 is in contact with the transfer belt 2 so as to impart a predetermined pushing force to the photosensitive drum 1. It should be noted that the magnitude and polarity of the voltage applied to the transfer roller 3 are set at various steps and polarity described herein later under the control performed by a transfer bias controller 54 that is operated under the control performed by the main control board 51 on the basis of the data on the various voltage values and polarity corresponding to the kind and thickness of the sheet-like material O stored in LUT2 (Look Up Table) 62. As a result, the magnitude and polarity of the transfer bias voltage applied from a transfer bias power supply 55 to the transfer roller 3 are changed. Incidentally, the transfer roller 3 is rotated at a predetermined speed in accordance with the moving speed of the transfer belt 2.

The surface of the photosensitive drum 1 is selectively irradiated with a laser beam corresponding to the image data and emitted from, for example, the light exposure device 5 of the laser beam system under the control performed by the main control board 51 so as to form an electrostatic latent image on the surface of the photosensitive body 1. The electrostatic latent image thus formed is developed by a toner supplied from the developing device 6 so as to form a toner image. The toner image thus formed is transferred toward the transfer belt 2 in accordance with rotation of the photosensitive drum 1.

A predetermined time after initiation of the laser beam irradiation performed by the light exposure apparatus 5, a paper feeding motor (not shown) is rotated by a paper feeding motor driving signal generated from the motor driver 52 under the control performed by the main control board 51 so as to rotate a paper feeding roller 9*a* or 91*a*. As a result, a paper sheet or a sheet-like material, which is a transparent resin sheet, is taken up one by one from a paper cassette 9 or a paper feeding tray 91 so as to be guided to a registration roller 10.

The registration motor 11 is rotated at a predetermined speed by a registration roller motor driving signal set in accordance with the thickness and kind of the sheet-like material O and supplied from the motor driver 52. The rotation of the registration motor 11 is transmitted to the registration roller 10 via a gear column 11*a* so as to move the sheet-like material O toward the transfer belt 2 at a speed equal to the moving speed of the outer circumferential surface of the photosensitive drum 1. To be more specific, the registration roller 10 transfers the paper sheet or the sheet-like material O, which is a transparent resin sheet, supplied from the paper cassette 9 or the paper feeding tray 91 toward the toner image transfer position at a predetermined timing from the initiation of laser beam irradiation, i.e., at the timing at which the tip end of the image including the toner image transferred by the rotation of the photosensitive drum 1 coincides with the tip end of the sheet-like material O at the transfer position noted above.

The sheet-like material O transferred to the transfer belt 2 by the rotation of the registration roller 10 is guided to the transfer position by the movement of the transfer belt 2 so as to be brought into contact with the toner image transferred by the rotation of the outer circumferential surface of the photosensitive drum 1.

At the transfer position, a transfer bias voltage of a predetermined magnitude and polarity, which is generated from the transfer bias power supply 55, is applied from the transfer roller 3, which is positioned to push the transfer belt 2 in contact with the photosensitive drum 1 toward the photosensitive drum 1, to the sheet-like material O interposed between the transfer belt 2 and the photosensitive drum 1. By the application of the transfer bias voltage, the toner image electrostatically attached to the outer circumferential surface of the photosensitive drum 1 is attracted toward the sheet-like material O so as to be transferred onto the sheet-like material O.

The transfer bias voltage generated from the transfer bias power supply 55 is set in accordance with the thickness and kind of the sheet-like material O, which are described herein later, by a transfer bias control signal generated from the transfer bias controller 54 under the control performed by the main control board 51. Also, the data stored in the second LUT (LUT2) 62 described previously is used as the instructive value (voltage value and polarity) of the transfer bias control signal generated from the transfer bias controller 54. In this case, it is possible for the instructive value of the transfer bias control signal to be changed on the basis of the humidity in the vicinity of the photosensitive drum 1, i.e., the humidity inside the printer, that is detected by a humidity sensor 21 for detecting the humidity in the vicinity of the photosensitive drum 1. It should be noted that it is possible to store the relationship between the humidity and the sheet-like material O in the second LUT (LUT2) 62. In this case, the humidity within the printer, which is detected by the humidity sensor 21, is converted into a digital signal by an A/D converter 56 so as to be supplied to the main control board 51 as the humidity data converted into the digital signal so as to refer to the table stored in the second LUT (LUT2) 62.

For example, a transfer bias voltage of the polarity (+) opposite to the charged polarity of the toner is applied from the transfer bias power source 55 to the transfer roller 3. By this transfer bias voltage, the toner image is transferred onto the sheet-like material O at the image transfer position. On the other hand, a positive charge (+) is also imparted from the transfer roller 3 to the transfer belt 2. As a result, a negative charge (−) is imparted to the sheet-like material O by the discharge when the sheet-like material O is peeled from the photosensitive drum 1. Since the positive charge (+) and the negative charge (−) attract each other, the sheet-like material O is electrostatically sucked by the transfer belt 2. It follows that the sheet-like material O, which has passed through the image transfer position, is moved together with the transfer belt 2.

The sheet-like material O having the toner image transferred thereonto is transferred by the transfer belt 2 so as to be brought into contact with a charge eliminating brush 12 and, then, guided to a fixing device 13. It should be noted that the sheet-like material O is peeled off the transfer belt 2 because the curvature of the driving roller 2*a* for driving the transfer belt 2 is smaller than the capability of the sheet-like material O to follow the curvature.

It should be noted that the driving roller 2*a* is connected to the ground in order to prevent the occurrence of discharge between the charge imparted to the sheet-like material O and the charge retained by the transfer belt 2. It should also be noted that the charge eliminating brush 12 serve to eliminate the residual charge remaining on the transfer belt 2 and the sheet-like material O as a result of the contact of the sheet-like material O with the photosensitive drum 1 or as a result of the supply of the transfer bias voltage to each of the transfer belt 2 and the sheet-like material O by the transfer roller 3. Therefore, the charge eliminating brush 12 consists of a brush body exhibiting an electrical conductivity and is connected to the ground. The charge eliminating capacity of the charge eliminating brush 12 is lower than that of an AC corona charger, which generates ozone. However, since the charge eliminating brush 12 does not generate ozone, the brush 12 can be manufactured at a low cost and is compact. It follows that the charge eliminating brush 12 is effective for suppressing the manufacturing cost of the printer apparatus 101.

The fixing device 13 comprises a cylindrical first roller (heating roller) 13*a* and a second roller (pressurizing roller)

13*b* having an axis parallel to the axis of the first roller 13*a*, arranged to extend in the axial direction of the first roller 13*a* and in contact with a point on the circumferential surface of the first roller 13*a*. One of the first and second rollers is rotated at a speed corresponding to the kind or thickness of the sheet-like material O in accordance with rotation of a fixing motor 14 and a transmitting mechanism 14*a*, which can be rotated with at least two steps of speed depending on the kind or thickness of the sheet-like material O. In the embodiment shown in FIG. 1, the first roller 13*a* is rotated in accordance with rotation of the fixing motor 14 and the transmitting mechanism 14*a* upon receipt of an instructive value generated from the motor driver 52 under the control performed by the main control board 51 corresponding to the speed data stored in the first LUT (LUT1) 61. The first and second rollers 13*a* and 13*b* receive a predetermined pressure generated by a pressurizing mechanism (not shown) so as to form a nip region at which the pressurizing roller 13*b* is temporality deformed. Since the sheet-like material O bearing the toner image is transferred into the nip region, the toner is melted and pressurized, with the result that the toner image is fixed to the sheet-like material O.

On the other hand, the residual toner remaining on the outer circumferential surface of the photosensitive drum 1 after transfer of the toner image onto the sheet-like material O at the image transfer position is transferred onto a cleaner 15 in accordance with rotation of the photosensitive drum 1 so as to be removed from the outer circumferential surface of the photosensitive drum 1. Also, the residual toner remaining on the outer circumferential surface of the photosensitive drum 1 is eliminated by an eraser 16 arranged downstream of the cleaner 15 in the rotating direction of the photosensitive drum 1. As a result, the surface potential of the photosensitive drum 1 is brought back to the original state before charging of a predetermined potential.

As described previously, a transfer bias voltage is applied from the transfer roller to the transfer belt and to the photosensitive drum at the toner image transfer position of the printer apparatus shown in FIG. 1. The magnitude, polarity and the applying timing of the transfer bias voltage will now be described in detail. In the following description of the magnitude and polarity of the transfer bias voltage, it is assumed that a transfer bias voltage is not applied to the transfer roller 3 in the non-transfer period (interval) during which the sheet-like material O is not transferred to the clearance between the transfer belt 2 and the photosensitive drum 1. In the printer apparatus using a roller-like transfer device, it is possible to apply a bias voltage of the opposite polarity or a bias voltage having an absolute value smaller than the transfer bias voltage, though the polarity is the same, in order to remove the stains such as the toner or the paper dust attached to the transfer roller or to prevent the toner of the opposite polarity from being attached to the background portion of the image formed on the sheet-like material O. However, in the printer apparatus shown in FIG. 1, it is possible to turn off the transfer bias voltage during the non-transfer period because the transfer belt 2 is used in the printer apparatus shown in FIG. 1 and the surface of the belt 2 is cleaned by a belt cleaner (not shown). It should also be noted that it is advantageous in terms of the life of the photosensitive drum 1 to turn off the transfer bias voltage during the non-transfer period even in the clearance in which the sheet-like material O is not present because, if the transfer bias voltage is applied continuously, the photosensitive drum 1 is charged with the positive (+) charge which is opposite to the original polarity so as to markedly increase the fatigue of the photosensitive drum 1 and, thus, to shorten the life of the photosensitive drum 1.

Incidentally, in the printer apparatus 101 shown in FIG. 1, the process speed, i.e., the moving speed of the outer circumferential surface of the photosensitive drum 1, in the case where the sheet-like material O consists of the ordinary paper sheet, is 175 mm, as described previously, the clearance is 140 mm, and the ppm (printout per minute) is 30 sheets.

The transfer bias power supply 55 of the printer apparatus shown in FIG. 1 is a constant voltage power supply. It should be noted that, if the ambient temperature or humidity of the photosensitive drum 1 is changed, the resistance of the sheet-like material O is changed so as to affect the appropriate bias. In the present invention, the influence given by the change in the appropriate bias is suppressed by controlling the transfer bias voltage in accordance with the absolute humidity by using the humidity sensor 21. Also, the magnitude of the transfer bias voltage is changed depending on the kind of the sheet-like material.

Figure 2:
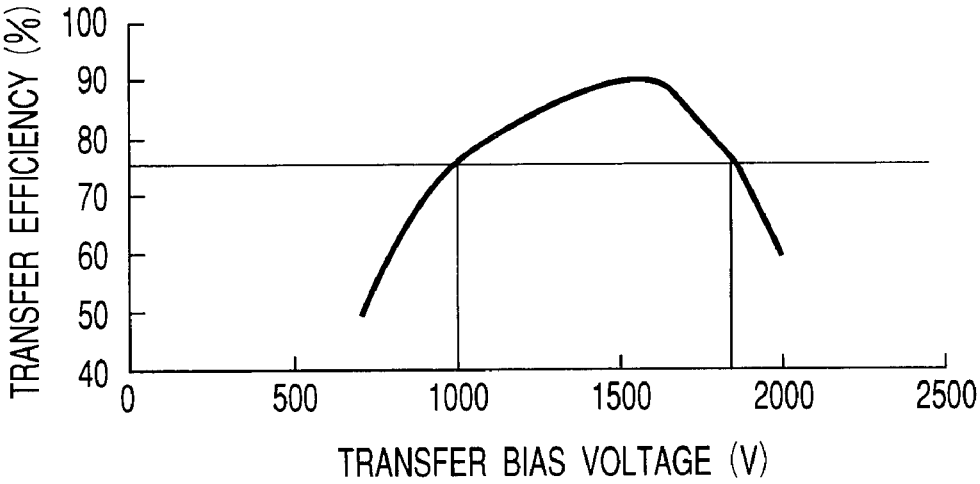
FIG. 2 is a graph showing the relationship between the magnitude of the transfer bias and the transfer efficiency provided by the transfer mechanism and the transfer bias voltage control method employed in the image forming apparatus shown in FIG. 1.

FIG. 2 is a graph showing the relationship between the transfer bias voltage and the transfer efficiency of the solid image under the environment of room temperature and normal humidity (23° C., 50% RH). Incidentally, the transfer efficiency can be obtained by the formula "[M1−M2]/M1× 100 (%)", where M1 represents the solid developing amount for a predetermined area, and M2 represents the residual toner amount after transfer of M1.

In practice, the transfer efficiency of the solid image is determined as follows:

1) A solid image sized as 30 mm×200 mm is formed on the photosensitive drum 1, and the weight of the toner on the photosensitive drum 1 is measured by an electronic balance without transferring the solid image so as to obtain M1.
2) The toner image formed under the same conditions is transferred onto a paper sheet, and the residual toner amount is measured by an electronic balance so as to obtain M2.
3) The transfer efficiency is obtained by the formula given above.

The graph of FIG. 2 can be obtained by changing the transfer bias voltage applied to the transfer roller 3 for every predetermined number of samples.

The defects given below are generated, if the transfer efficiency is lowered:

(a) The image density is lowered so as to make the image defective.
(b) If the residual toner after the image transfer is increased, the load applied to the cleaner 15 is increased so as to shorten the life of the cleaner 15.

Under the circumstances, the transfer bias voltage of 1000V to 1800V, which permits ensuring a transfer efficiency of at least 75% is an appropriate transfer bias voltage as described below with reference to FIG. 3.

Figure 3:
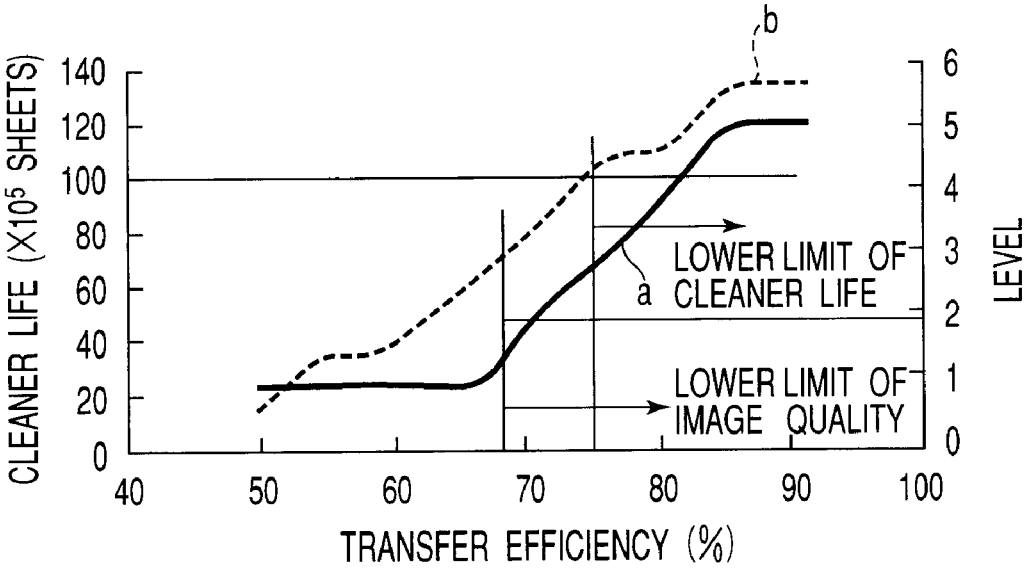
FIG. 3 is a graph showing the relationship between the transfer efficiency shown in FIG. 2 and the life of the cleaner.

Specifically, FIG. 3 is a graph showing the relationship among the transfer efficiency, the image quality allowable level evaluated by the visual observation of the transferred toner image, and the life of the cleaner 15, i.e., the number of allowable toner image formations until occurrence of the cleaning defect. Curve (a) (solid line) in the graph shows the image quality allowable level evaluated by 6 stages, with curve (b) (broken line) showing the cleaner life (the number of allowable toner image formations until generation of the cleaning defect by the cleaner 15) evaluated by 6 stages.

As shown in FIG. 3, if the transfer efficiency is lowered, the concentration of the image is lowered so as to deteriorate the image quality. In this case, the amount of the residual toner is increased so as to increase the load applied to the cleaner 15, with the result that the life of the cleaner 15 is shortened. Since the lower limit of the image quality allowable level is set at stage 2 of the 6 stages, the transfer efficiency for satisfying the image quality is at least 68%.

On the other hand, since the cleaner life that must be guaranteed by the printer apparatus 101 is 105 sheets, it is necessary to ensure at least 75% of the transfer efficiency. In view of both the image quality allowable level and the cleaner life, it is necessary for the transfer efficiency to be at least 75%. It follows that the appropriate transfer bias voltage that permits ensuring at least 75% of the transfer efficiency, which was referred to in conjunction with FIG. 2, must be 1000 to 1800V.

The relationship between the generation of the memory image by the transfer bias voltage and the transfer bias voltage will now be described.

EXAMPLE 1

Figures 4A, 4B, 4C, 4D:
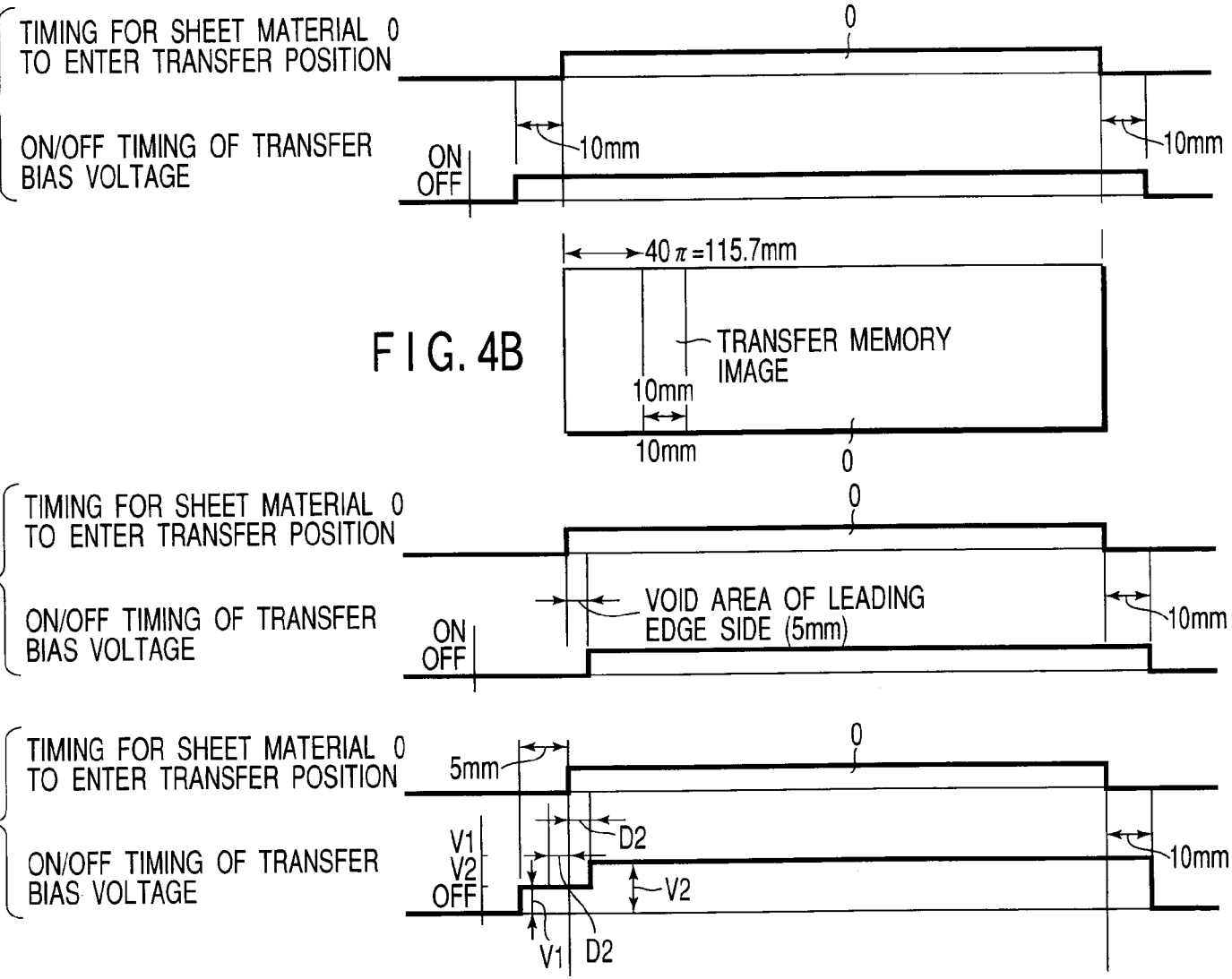

If a half tone image is formed on the entire surface by setting the timing of supplying a transfer bias voltage to the transfer roller 3, i.e., the timing of turning on the transfer operation, at 10 mm before the tip of the sheet-like material O is transferred to reach the toner image transfer position as shown in FIG. 4A, formed is a memory image by the transfer bias voltage M in which the concentration of the half tone is high as shown in FIG. 4B. Since the outer diameter of the photosensitive drum 1 is 40 mm, the memory image by the transfer bias voltage M is formed at the position of 115.7 (125.7 (40π)−10) mm from the tip of the sheet-like material O over a width of 10 mm.

Figure 5:
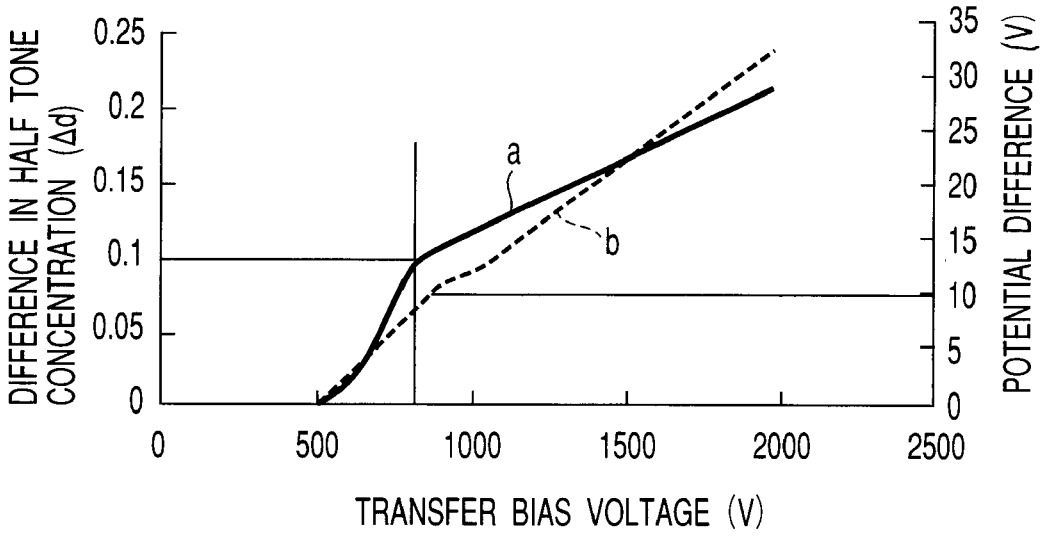
FIG. 5 is a graph showing the relationship between the magnitude of the transfer bias voltage provided by the transfer bias voltage control method of the present invention, which is utilized in the image forming apparatus shown in FIG. 1, and the image concentration of the half tone portion of the memory image by the transfer bias voltage, and also showing the potential difference between the potential of the half tone portion of the memory image by the transfer bias voltage relative to the magnitude of the transfer bias voltage provided by the transfer bias voltage control method of the present invention and the potential of the half tone portion of an image has no memory image by the transfer bias voltage.

If the relationship between the half tone concentration of the memory image by the transfer bias voltage M and the surface potential of the photosensitive drum 1 is examined, it is recognized that, if the transfer bias voltage is increased, the potential of the photosensitive drum 1 is lowered in the memory image by the transfer bias voltage portion M, leading to an increase in the half tone concentration, as shown in FIG. 5.

As shown in FIG. 5, if the transfer bias voltage exceeds 800V, the difference ΔVo between curve (a) (solid line) representing the surface potential of the photosensitive drum 1 in the memory image by the transfer bias voltage portion and curve (b) representing the portion where the memory image by the transfer bias voltage is not generated is increased to exceed 10V, and the difference Δd in the concentration of the half tone image is also increased to exceed 0.1 so as to recognize the difference as a nonuniform concentration (memory image by the transfer bias voltage M).

FIG. 5 covers the case where a predetermined bias voltage was applied to the photosensitive drum 1 directly without using the sheet-like material O. It is recognized that the half tone concentration of the memory image by the transfer bias voltage M is caused to have a level of a defective image by only application of a transfer bias voltage not lower than 800V to the photosensitive drum 1. It follows that there is no transfer bias voltage that permits a good toner image transfer and that does not generate the memory image by the transfer bias voltage M even if the transfer bias voltage is applied to the photosensitive drum 1 in the clearance within the range of the appropriate transfer bias voltage (1000 to 1800V), which was obtained in FIGS. 2 and 3.

Then, it is assumed that the transfer bias power source is turned on in the void area of, for example, 5 mm inside the tip of the sheet-like material O, as shown in FIG. 4C.

It appears that there is no problem if the transfer bias power source is turned on 2.5 mm as a design value inside the tip of the sheet-like material O. However, there is a nonuniformity in the time when the sheet-like material O actually arrives at the transfer position. If the sheet-like material O arrives at the toner image transfer position at least 2.5 mm (15 msec) earlier than the design value, the sheet-like material O exceeds the image void area to enter the image region, with the result that a transferred portion (image dropout portion) is generated in the reading edge portion of the image.

On the other hand, if the arrival of the sheet-like material O is delayed by at least 2.5 mm, the transfer bias voltage is turned on prior to the reading edge portion of the sheet-like material O so as to generate the memory image by the transfer bias voltage M.

As a practical problem, the deviation of the time when the sheet-like material O enters the toner image transfer position is at least 50 msec (in terms of the distance, 175 mm/sec×50 msec=8,75 mm), it is impossible to turn on the transfer bias voltage without fail within the range of 5 mm of the image void area. It follows that, in the method of turning on the transfer bias voltage within the image void area, there is no condition under which the tip of the image is not dropped out and the memory image by the transfer bias voltage is not formed.

Under the circumstances, considered is a method of turning on the transfer bias voltage with the transfer bias voltage V1 (V) of a first magnitude, in which the memory image by the transfer bias voltage is not generated outside sheet-like material O, and changing the transfer bias voltage to a transfer bias voltage V2 (V) of a second magnitude higher than the transfer bias voltage V1 of the first magnitude inside the sheet-like material O, said transfer bias voltage V2 of the second magnitude not generating a cleaning defect in respect of the life of the cleaner 15. To be more specific, the transfer bias voltage is turned on with a low transfer bias voltage that does not generate a memory image by the transfer bias voltage in the reading edge portion of the sheet-like material O and, then, the transfer bias voltage is increased to the transfer bias voltage not lower than 1000V a predetermined period of time later.

Toner images were printed out a plurality of times by setting the magnitude of the second transfer bias voltage V2 at 1200V and setting the timing of turning on the first transfer bias voltage V1 at a point 5 mm from the tip of the sheet-like material O, with the timing of the switch from the first transfer bias voltage to the second transfer bias voltage used as a parameter for observation of:

(a) visual evaluation of the toner image in the reading edge portion of the sheet-like material O and the entire solid image;

(b) the life of the cleaner 15; and (c) the generation of the memory image by the transfer bias voltage.

Table 1 shows the results.

TABLE 1

| D2 (mm) | V1 (V) | Image quality in leading edge side of the transfer material | Solid image | Memory image by transfer bias voltage | Cleaner life |
|---|---|---|---|---|---|
| 3 | 400 | x | x | x | ○ |
| | 600 | ○ | ○ | x | ○ |
| | 800 | ○ | ○ | x | ○ |
| | 1000 | ○ | ○ | x | ○ |
| | 1200 | ○ | ○ | x | ○ |
| 5 | 400 | x | ○ | ○ | ○ |
| | 600 | ○ | ○ | ○ | ○ |
| | 800 | ○ | ○ | ○ | ○ |
| | 1000 | ○ | ○ | x | ○ |
| | 1200 | ○ | ○ | x | ○ |
| 8 | 400 | x | ○ | ○ | ○ |
| | 600 | ○ | ○ | ○ | ○ |
| | 800 | ○ | ○ | ○ | ○ |
| | 1000 | ○ | ○ | x | ○ |
| | 1200 | ○ | ○ | x | ○ |
| 10 | 400 | x | x | ○ | ○ |
| | 600 | ○ | x | ○ | ○ |
| | 800 | ○ | x | ○ | ○ |
| | 1000 | ○ | ○ | x | ○ |
| | 1200 | ○ | ○ | x | ○ |

It should be noted that the result of evaluation differs for each sheet even under the same conditions because of the nonuniformity of the timing for the sheet-like material to arrive at the toner image transfer position. Therefore, the toner images were repeatedly printed out on 50 sheets, and the worst results for each condition are given in Table 1 for each of items (a) to (c) given above.

As apparent from Table 1, the life of the cleaner 15 is scarcely affected by the first transfer bias voltage and is dependent on the magnitude of the second transfer bias voltage. Incidentally, it is seen that the memory image by the transfer bias voltage is generated regardless of the magnitude of the first transfer bias voltage under the situations that the time D2 between the tip of the sheet-like material O and the application of the second transfer bias voltage is small and that the arrival of the sheet-like material O is delayed so as to apply the second transfer bias voltage V2 outside the sheet-like material O. On the other hand, the generating situation of the memory image by the transfer bias voltage is dependent on the magnitude of the first transfer bias voltage if D2 is not smaller than 5 mm. As described previously, the memory image by the transfer bias voltage is not generated if the first transfer bias voltage is not higher than 800V.

Concerning the toner image in the reading edge portion, it is possible for the first transfer bias voltage V1 to be 600V because there is no practical problem even if the transfer state is somewhat low. However, concerning the entire solid toner image, the image drop out is generated in the reading edge portion in the case where the first transfer bias voltage is low and D2 is large. It follows that D2 is restricted in the case where V1 is set at 600V.

Under the circumstances, it is possible to obtain the toner image transfer conditions under which a defective toner image transfer dose not take place in the reading edge portion of the sheet-like material O, the defective cleaning does not take place in respect of the life of the cleaner, and the memory image by the transfer bias voltage is not generated by setting the first transfer bias voltage to fall within a range of between 600V and 800V and by setting the timing of the switch from the first transfer bias voltage V1 to the second transfer bias voltage V2 at 5 to 8 mm from the tip of the sheet-like material O.

As described above, the appropriate value of the first transfer bias voltage V1 is considered to be 800V, and the appropriate value of D2 is considered to be 6 mm.

It should be noted, however, that (a) the transfer bias voltage that permits at least 75% of the transfer efficiency, and (β) the transfer bias voltage that does not generate a memory image by the transfer bias voltage on the photosensitive drum 1 and that does not generate a defective image in the reading edge portion are changed greatly depending on the change in the environment (temperature and humidity).

Figure 6:
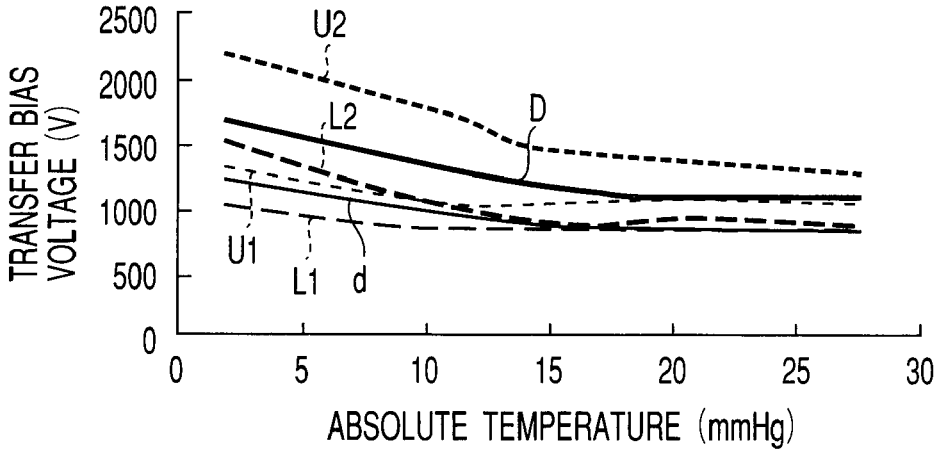
FIG. 6 is a graph showing the relationship between the magnitude of the transfer bias voltage provided by the transfer bias voltage control method of the present invention utilized in the image forming apparatus shown in FIG. 1 and the absolute humidity, and covering the case where the transfer bias voltage is set on the basis of the magnitude of the transfer bias voltage and the concentration of the half tone image shown in FIG. 5.

Therefore, the upper limit and the lower limit of each of the first transfer bias voltage V1 and the second transfer bias voltage V2 were obtained in respect of the environment (absolute humidity) and the transfer bias voltages satisfying (α) and (β) given above, with the result that the dependency of the transfer bias voltage on the absolute temperature was recognized as shown in FIG. 6. In the graph of FIG. 6, curve $U_1$ represents the upper limit of the first transfer bias voltage V1, curve $U_2$ represents the upper limit of the second transfer bias voltage V2, curve $L_1$ represents the lower limit of the first transfer bias voltage V1, curve $L_2$ represents the lower limit of the second transfer bias voltage V2, curve d represents the calculated value of the first transfer bias voltage V1, and curve D represents the set value of the second transfer bias voltage V2.

As apparent from FIG. 6, each of the first and second transfer bias voltages V1 and V2 is changed depending on the change in the environment (absolute humidity). Therefore, although a table is stored in the second LUT (LUT2) 62 as described previously, the required memory capacity is increased very much if a table is set for each of the transfer bias voltages V1 and V2 in respect of the environment.

Under the circumstances, Example 1 employs the system that the second transfer bias voltage V2 alone is stored in the second LUT (LUT2) 62 as a table, and the first transfer bias voltage V1 is calculated from the second transfer bias voltage V2. It should be noted in this connection that, since the transfer bias voltage is changed depending on not only the environmental conditions but also the kind of the paper sheet, the life of the transfer device, etc., the required memory capacity is increased very much so as to increase the cost relating to the memory, if the apparatus is constructed to include the tables for both the first and second transfer bias voltages V1 and V2. However, the apparatus of Example 1 does not include a memory for storing the table for the first transfer bias voltage V1 as described above, making it possible to reduce the memory capacity to a half.

For example, the first transfer bias voltage V1 can be obtained as follows on the basis of the table in which the value of the second transfer bias voltage V2 is changed depending on the environment like curve $d_2$ shown in FIG. 6:

$$V1=0.65\times V2+110 \quad (1)$$

Curve d shown in FIG. 6 represents the calculated value thus obtained.

As described above, in Example 1 in which are used the first and second transfer bias voltages V1 and V2, it is possible to maintain the first transfer bias voltage V1 at an appropriate voltage value. To be more specific, the apparatus of Example 1 includes the set value of the appropriate bias voltage V2 of the second transfer bias voltage relative to the absolute temperature as a table, and the value of the first transfer bias voltage V1 is calculated on the basis of the second transfer bias voltage V2.

In Example 1, the length of one complete rotation of the photosensitive drum 1, i.e., the outer circumferential length of the photosensitive drum 1, which is 40 π=125.7 mm, is smaller than the clearance (140 mm) between the adjacent sheet-like materials O in successively printing out the toner images. Therefore, concerning the trailing edge portion of the sheet-like material O, the memory image by the transfer bias voltage is not generated in the succeeding sheet-like material O on which the next toner image is printed out, if the transfer bias voltage is turned off within 14 mm on the outside from the trailing edge portion of the sheet-like material O. Under the circumstances, concerning the trailing edge portion of the sheet-like material O, the two stage control (V2→V1) as shown in FIG. 4D is not applied by turning off the transfer bias voltage in 3 mm outside the trailing edge portion.

EXAMPLE 2

In Example 1 described above, the distance between the adjacent sheet-like materials O is set at 140 mm during the continuous print out of the toner images. In Example 2, however, the distance between the adjacent sheet-like materials O is set at 100 mm during the consecutive print out of the toner images. Incidentally, a constant current power source is used as the transfer bias power source 55 in Example 2.

Figure 7:
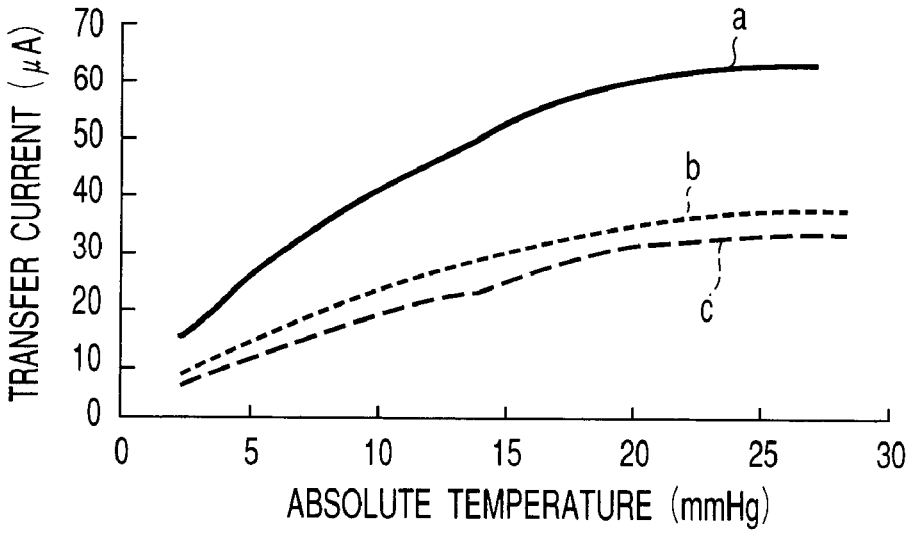
FIG. 7 is a graph showing the relationship between the magnitude of the transfer current provided by the transfer mechanism and the transfer bias voltage control method utilized in the image forming apparatus shown in FIG. 1 and the absolute humidity.

FIG. 7 is a graph showing the upper limit and the lower limit of the transfer bias voltage that permits ensuring at least 75% of the transfer efficiency even if the absolutely temperature is changed and the transfer bias voltage (constant current) that does not generate a memory image by the transfer bias voltage. In FIG. 7, a curve (a) represents the upper limit of the transfer bias current, curve (b) represents the lower limit of the transfer bias current, and curved (c) represents the upper limit of the transfer bias current that does not generate a memory image by the transfer bias voltage. In this example, the timing of turning on the transfer bias voltage is set at 10 mm from the tip of the sheet-like material O, i.e., the timing shown in FIG. 4A.

As apparent from FIG. 7, the upper limit of the transfer bias voltage (constant current) that does not generate a memory image by the transfer bias voltage is lower than the lower limit of the appropriate transfer bias voltage (constant current). Therefore, there is no condition meeting the both as in the case of using the constant voltage power source in Example 1. In other words, it is clear that a memory image by the transfer bias voltage is formed on the photosensitive drum 1, if a transfer bias voltage is applied to the photosensitive drum 1 under the state that the sheet-like material O is not present as described previously in conjunction with FIGS. 4A and 4B.

Under the circumstances, a constant current type transfer bias voltage is applied by a weak transfer bias current I1 (first transfer bias voltage V1) before the tip of the sheet-like material O, and a predetermined transfer bias current I2 (second transfer bias voltage V2) is applied to the sheet-like material O within the sheet-like material O.

Toner images were printed out a plurality of times under an environment of 23° C. and 50% RH by setting the timing of turning on the current value (constant current) I1 capable of providing the first transfer bias voltage (constant current) weaker than the current value (constant current) I2 capable of providing a predetermined (second) transfer bias voltage (constant current) at a point 5 mm ahead of the tip of the sheet-like material O and by fixing the current value I2 capable of providing the predetermined (second) transfer bias voltage (constant current) at 32 μA, with the timing D3 (which corresponds to D2 shown in FIG. 4D) for the switch from the first current value I1 to the second current value I2 and the current value I1 capable of providing the first transfer bias voltage (constant current) used as parameters, for observation of:

(1) visual evaluation of the toner image in the reading edge portion of the sheet-like material O and the entire solid image;

(2) the life of the cleaner 15; and (3) the generation of the memory image by the transfer bias voltage.

Table 2 shows the results.

TABLE 2

| D2 (mm) | I1 (μA) | Image quality in leading edge side of the transfer material | Solid image | Memory image by transfer bias voltage | Cleaner life |
|---|---|---|---|---|---|
| 3 | 13 | x | x | x | ○ |
| | 15 | ○ | ○ | x | ○ |
| | 17 | ○ | ○ | x | ○ |
| | 19 | ○ | ○ | x | ○ |
| | 21 | ○ | ○ | x | ○ |
| 5 | 13 | x | ○ | ○ | ○ |
| | 15 | ○ | ○ | ○ | ○ |
| | 17 | ○ | ○ | ○ | ○ |
| | 19 | ○ | ○ | ○ | ○ |
| | 21 | ○ | ○ | x | ○ |
| 8 | 13 | x | ○ | ○ | ○ |
| | 15 | ○ | ○ | ○ | ○ |
| | 17 | ○ | ○ | ○ | ○ |
| | 19 | ○ | ○ | ○ | ○ |
| | 21 | ○ | ○ | x | ○ |
| 10 | 13 | x | x | ○ | ○ |
| | 15 | ○ | x | ○ | ○ |
| | 17 | ○ | x | ○ | ○ |
| | 19 | ○ | x | ○ | ○ |
| | 21 | ○ | ○ | x | ○ |

It should be noted that the result of evaluation differs for each sheet even under the same conditions because of the nonuniformity of the timing for the sheet-like material to arrive at the toner image transfer position. Therefore, the toner images were repeatedly printed out on 50 sheets, and the worst results for each condition are given in Table 2 for each of items (1) to (3) given above.

As apparent from Table 2, it is recognized that it is possible to ensure at least 75% of the transfer efficiency without giving rise to the memory image by the transfer bias voltage and the life of the cleaner 15 is not adversely affected under the conditions that the D3 falls within a range of between 5 and 8 mm, and the current value II falls within a range of between 15 and 19 μA. However, the values of the appropriate current values I1 and I2 are greatly changed depending on the environment as shown in FIG. 8, though the range of D3 is not greatly changed depending on the change in the environment.

Figure 8:
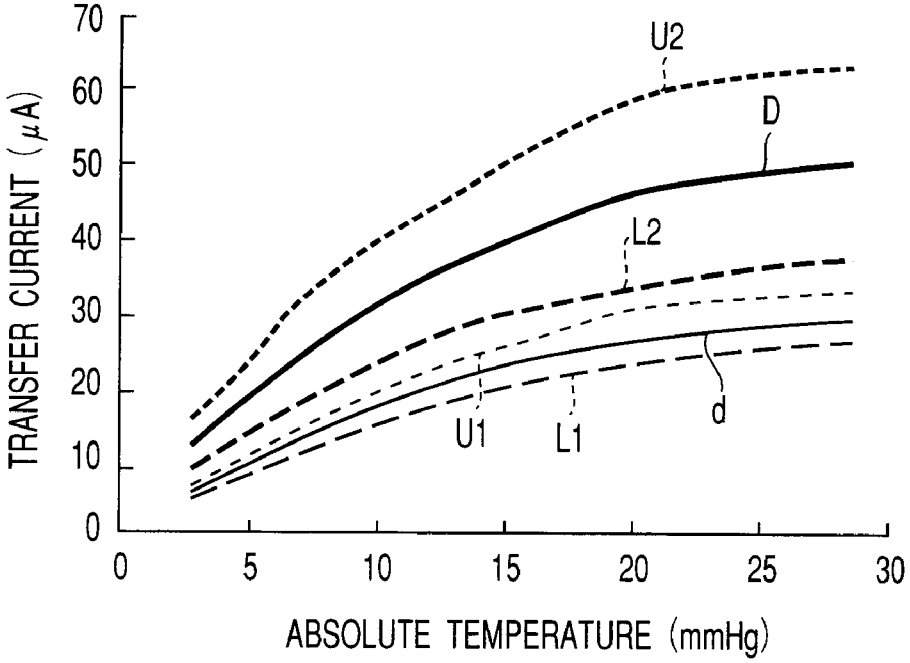
FIG. 8 is a graph showing the relationship between the magnitude of the transfer current provided by the transfer mechanism and the transfer bias voltage control method utilized in the image forming apparatus shown in FIG. 1 and the absolute humidity, covering the case where the first bias voltage V1 is set on the basis of the relationship between the magnitude of the transfer current and the absolute humidity shown in FIG. 7.

FIG. 8 is a graph showing the upper limit and the lower limit of each of the transfer current I1 capable of providing the first transfer bias voltage V1 and the transfer current I2 capable of providing the second transfer bias voltage V2. The dependency of the transfer current on the absolute humidity is recognized as in the transfer bias voltage described previously. Curve $U_1$ shown in FIG. 8 represents the upper limit of the transfer current I1 capable of providing the first transfer bias voltage V1, curve $U_2$ represents the upper limit of the transfer current I2 capable of providing the second transfer bias voltage V2, curve $L_1$ represents the lower limit of the transfer current I1, curve $L_2$ represents the lower limit of the transfer current I2, curve d represents the calculated value of the transfer current I1, and curve D represents the set value of the transfer current I2.

Also, a table is stored in the second LUT (LUT2) 62. However, as described previously in conjunction with FIG. 6, if a table is arranged for each of the transfer currents I1, I2 in respect of the environment, the required memory capacity is increased very much. Therefore, it is possible to obtain the transfer current I1 capable of providing the first transfer bias voltage V1 (constant current) as follows on the basis of the table for the transfer current I2 capable of providing a predetermined transfer bias voltage (constant current):

$$I1=0.6\times I2-2 \quad (2)$$

Curve d shown in FIG. 8 represents the calculated value thus obtained. Also, the timing of turning on the transfer current I1 is set 5 mm outside of the tip of the sheet-like material O, and the timing of the switch from the transfer current I1 to the transfer current I2 is set at a position 7 mm from the tip of the sheet-like transfer material O.

Figure 9A:
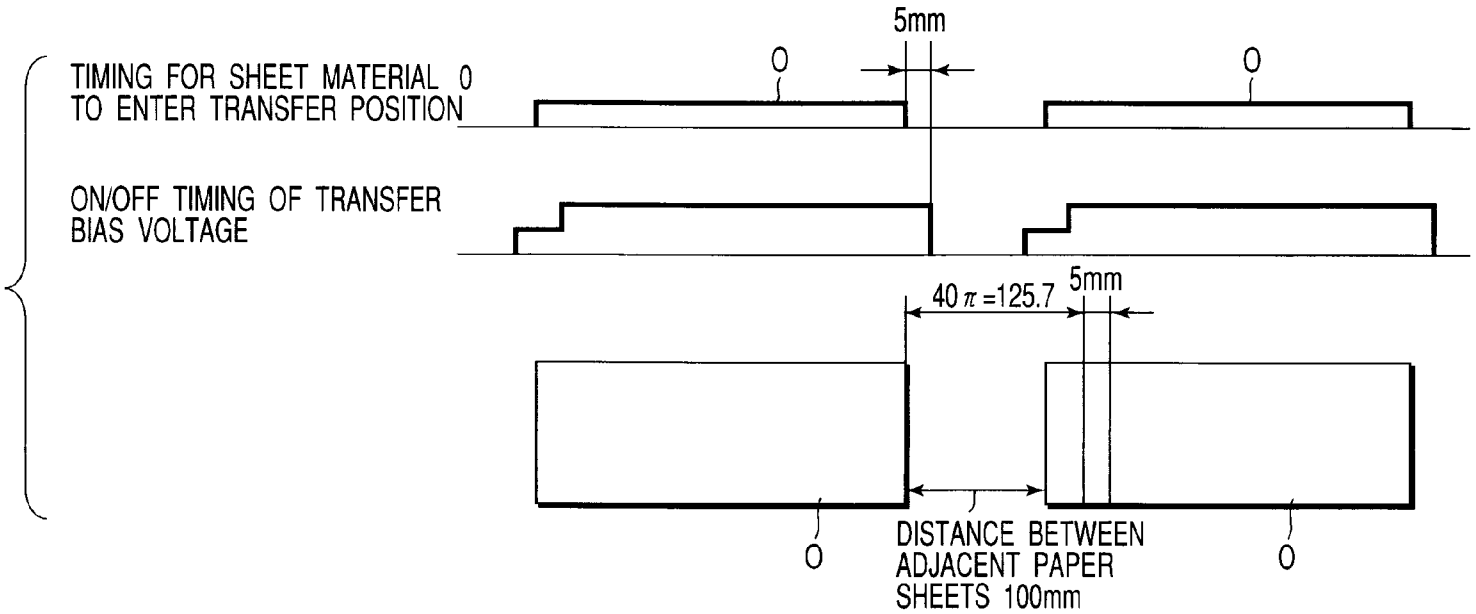
FIG. 9A schematically shows the relationship between the memory image by the transfer bias voltage generated by the transfer bias voltage applied by the transfer bias voltage control method of the present invention shown in FIG. 4D and the distance between the adjacent sheet-like materials in successively printing out images on the sheet-like materials O.

It is possible to achieve the life of the cleaner 15 of at least $10^5$ sheets while preventing the drop out of the toner image in the tip of the sheet-like material O and preventing the generation of the memory image by the transfer bias voltage by controlling the current value capable of providing the particular transfer bias voltage (constant current) from the transfer current I1 to the transfer current I2 in two stages.

Where the toner images are successively printed out in Example 2, the memory image by the transfer bias voltage generated at the trailing edge portion of the sheet-like material O appears at the front end of the toner image printed out on the succeeding sheet-like material O because the distance between the adjacent sheet-like materials O is shorter than the length of one complete rotation of the photosensitive drum 1, i.e., the outer circumferential length of the photosensitive drum 1. For example, where the transfer bias voltage (constant current) is turned off in a region 5 mm outside of the trailing edge portion of the sheet-like material O, i.e., the region where the sheet-like material O is not present, a memory image by the transfer bias voltage (half tone is thickened) is generated in a region raging between 25.7 (=40 π−100) mm and 30.7 mm from the tip of the sheet-like material O on which the next toner images are printed out, as shown in FIG. 9A.

Figure 9B:
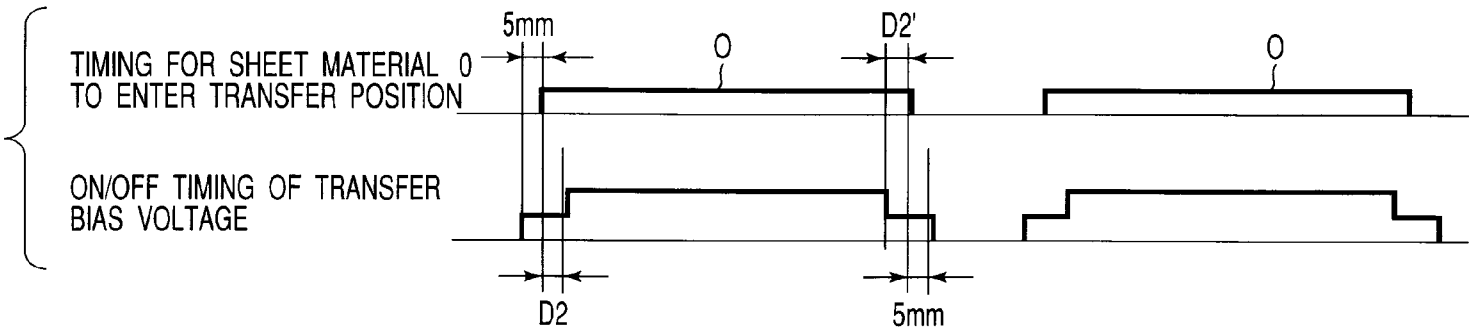
FIG. 9B is a timing chart directed to another embodiment of the present invention for controlling the transfer bias voltage and showing the timing of changing stepwise the transfer bias voltage in front of the trailing edge portion of the sheet-like material O.

Under the circumstances, in Example 2, a two stage control, in which the current value of the transfer current is switched from I2 to I1 in the timing D' and, then, the transfer current I1 is turned off a predetermined period of time later, is employed in turning off the transfer bias voltage, as shown in FIG. 9B in also the trailing edge portion of the sheet-like material O as in the front end.

Toner images were printed out a plurality of times by fixing the current value I2 of the transfer current and by fixing the timing of turning off the transfer bias voltage at a point 5 mm outside of the sheet-like material O, with the current value I1 uses as a parameter, for observation of:

(1') visual evaluation of the toner image in the reading edge portion of the sheet-like material O and the entire solid image;

(2') the life of the cleaner 15; and (3') the generation of the memory image by the transfer bias voltage in the toner images printed out.

Table 3 shows the results.

TABLE 3

| D2 (mm) | I1 (μA) | Image quality in leading edge side of the transfer material | Solid image | Memory image by transfer bias voltage | Cleaner life |
|---|---|---|---|---|---|
| 3 | 13 | x | x | x | ○ |
| | 15 | ○ | ○ | x | ○ |
| | 17 | ○ | ○ | x | ○ |
| | 19 | ○ | ○ | x | ○ |
| | 21 | ○ | ○ | x | ○ |
| 5 | 13 | x | ○ | ○ | ○ |
| | 15 | ○ | ○ | ○ | ○ |
| | 17 | ○ | ○ | ○ | ○ |
| | 19 | ○ | ○ | ○ | ○ |
| | 21 | ○ | ○ | x | ○ |
| 8 | 13 | x | ○ | ○ | ○ |
| | 15 | ○ | ○ | ○ | ○ |
| | 17 | ○ | ○ | ○ | ○ |
| | 19 | ○ | ○ | ○ | ○ |
| | 21 | ○ | ○ | x | ○ |
| 10 | 13 | x | x | ○ | ○ |
| | 15 | ○ | x | ○ | ○ |
| | 17 | ○ | x | ○ | ○ |
| | 19 | ○ | x | ○ | ○ |
| | 21 | ○ | ○ | x | ○ |

In this case, the appropriate current values of the transfer currents I1 and I2 are the current values shown in FIG. 8. It follows that it suffices to set the magnitude of the transfer current I2 as described previously in conjunction with FIG. 8 and to employ the current value I1 calculated by using formula (2).

It is possible to diminish the distance between the adjacent sheet-like materials in successively forming a plurality of printouts of the toner images so as to increase the number of printout sheets per unit time without generating a memory image by the transfer bias voltage on the sheet-like material O of the next printout by controlling the current value capable of providing the transfer bias voltage (constant current) from the transfer current I1 to the transfer current I2 in two stages at the trailing edge portion of the sheet-like material O. As a result, it is possible to prevent the drop out of the toner image in the tip of the sheet-like material O so as to achieve the life of the cleaner 15 of at least $10^5$ sheets.

Table 3 shows the results of the judgment in respect of the timing D' for the switch of the current value of the transfer current from I2 to I1, the magnitude of the current value of the transfer current I1, the visual observation of the toner image in the trailing edge portion of the sheet-like material O, and occurrence of the memory image by the transfer bias voltage in the next print out.

As apparent from Table 3, it is seen that the transfer state of the toner image is satisfactory in the trailing edge portion of the sheet-like material O in the point 5 to 8 mm inside from the trailing edge portion of the sheet-like material O in the case where the current value of the transfer current is decreased from I2 to I1.

Under the circumstances, in the constant current control in Example 2, the current value I2 of the predetermined transfer current, i.e., the current value that should be applied to the region excluding the front end and the trailing edge portion of the sheet-like material O, is selected, the current value I1, in which the current value of the transfer current should be lowered at the trailing edge portion of the sheet-like material O, is determined by formula (2), the current value is switched form I2 to I1 at a point 7 mm inside from the trailing edge portion of the sheet-like material, and the transfer bias voltage (constant current) is turned off at a point 5 mm outside the sheet-like material O.

EXAMPLE 3

Figure 10:
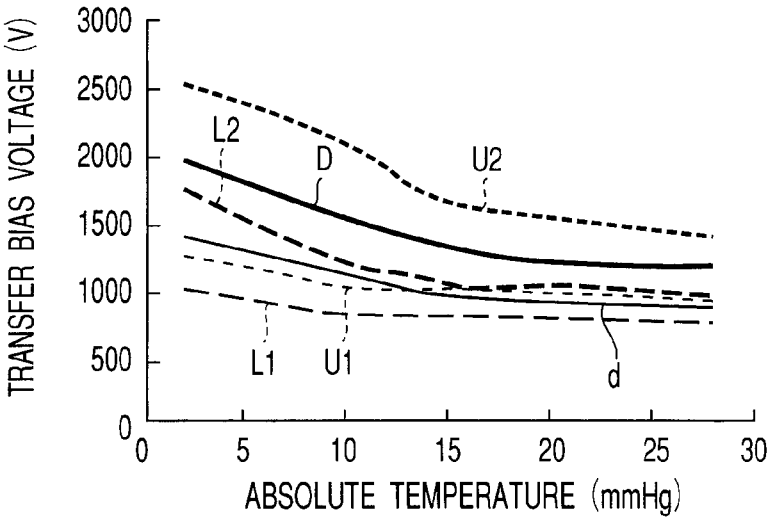
FIG. 10 is a graph showing the relationship between the magnitude of the transfer bias voltage provided by the transfer mechanism and the transfer bias voltage control method for the image forming apparatus shown in FIG. 1 and the absolute humidity, covering an example of setting an appropriate transfer bias voltage for the case where the sheet-like material O is a transparent resin sheet for an OHP.

FIG. 10 shows the transfer bias voltage adapted for forming a printout on a sheet-like material O having a thickness of about 120 g/m$^2$ (i.e., a card board) by using the printer apparatus shown in FIG. 1 by the two stage control of the transfer bias voltage as shown in FIG. 4D and Table 1. As described previously, the transfer bias voltage is greatly dependent on the environment (temperature and humidity). Therefore, the upper limit and the lower limit for each of the first transfer bias voltage V1 and the second transfer bias voltage V2 is obtained as described previously in conjunction with FIG. 6. Curve $U_1$ shown in FIG. 10 represents the upper limit of the first transfer bias voltage V1, curve $U_2$ represents the upper limit of the second transfer bias voltage V2, curve $L_1$ represents the lower limit of the first transfer bias voltage V1, curve $L_2$ represents the lower limit of the second transfer bias voltage V2, curve d represents the calculated value of the first transfer bias voltage V1, and curve D represents the set value of the second transfer bias voltage V2.

As apparent from FIG. 10, concerning the appropriate values of the first and second transfer bias voltages V1 and V1 for each environment (temperature and humidity) relative to the sheet-like material O having a thickness of about 120 g/m$^2$, the first transfer bias voltage (particularly, the upper limit value) is a very low voltage relative to the second transfer bias voltage V2 in a region having a low absolute humidity. It follows that, if it is intended to obtain the first transfer bias voltage V1 (calculated value d) from the second transfer bias voltage V2 (set value D) by the method similar to that described previously, the calculated value d of the first transfer bias voltage V1 requires a voltage higher than the upper limit $U_1$ of the first transfer bias voltage V1. In other words, the value is deviated from the appropriate region of the transfer bias voltage V1 ($U_1$–$U_2$).

Under the circumstances, in Example 3, if the card board key 73 of the control panel 71 is depressed so as to select the card board mode, or if the image data supplied from the outside via the interface 81 and the thickness of the sheet-like material O used in the print out step are designated, the magnitude of the first transfer bias voltage V1 is set by formula (3) given above, which differs from any of formulas (1) and (2) given previously:

$$I1=0.55\times I2+100 \quad (3)$$

Figure 11:
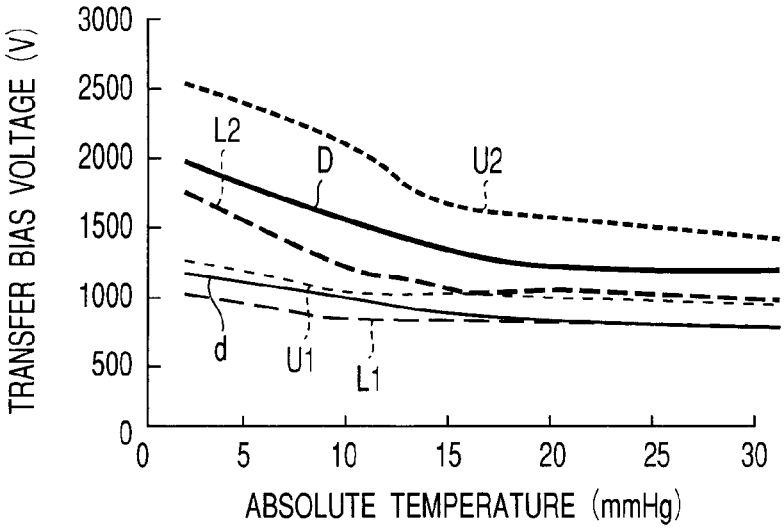
FIG. 11 is a graph showing the relationship between the magnitude of the transfer bias voltage provided by the transfer mechanism and the transfer bias voltage control method employed in the image forming apparatus shown in FIG. 1 and the absolute humidity, covering an example of setting an appropriate transfer bias voltage for the case where the sheet-like material O is a thick paper sheet having a thickness larger than 120 $g/m^2$.

FIG. 11 is a graph showing the relationship between the absolute humidity and each of the calculated value of the first transfer bias voltage V1, the upper limit of the first transfer bias voltage V1, the lower limit of the first transfer bias voltage V1, the set value of the second transfer bias voltage V2, the upper limit of the second transfer bias voltage V2, and the lower limit of the first transfer bias voltage V2 for the card board obtained by formula (3). In FIG. 11, curve $U_1$ represents the upper limit of the first transfer bias voltage V1, curve $U_2$ represents the upper limit of the second transfer bias voltage V2, curve $L_1$ represents the lower limit of the first transfer bias voltage V1, curve $L_2$ represents the lower limit of the second transfer bias voltage V2, curve d represents the calculated value of the first transfer bias voltage V1, and curve D represents the set value of the second transfer bias voltage V2, as in the example described previously.

EXAMPLE 4

This example is directed to the transfer bias voltage adapted for forming the printout by using the printer apparatus shown in FIG. 1, covering the case where the sheet-like material O is a transparent resin sheet.

Toner images were printed out a plurality of times under an environment of 23° C. and 50% RH by setting the timing of turning on the first transfer bias voltage V1 at a point 5 mm outside the tip of the sheet-like material O for the OHP (OHP sheet), by setting the timing of the switch from the first transfer bias voltage V1 to the second transfer bias voltage V2 at a point 7 mm inside the tip of the sheet-like material O, and by changing the magnitude of the first transfer bias voltage V1 with the magnitude of the second transfer bias voltage V2 set at 2800V (transfer efficiency of 89%) for observation of the occurrence of the memory image by the transfer bias voltage and for the visual evaluation of the toner image at the tip of the sheet-like material O. Table 4 shows the results:

TABLE 4

| D2 (mm) | V1 (V) | Image quality in leading edge side of the transfer material | Solid image | Memory image by transfer bias voltage | Cleaner life |
|---|---|---|---|---|---|
| 3 | 400 | x | x | x | ○ |
| | 600 | x | x | x | ○ |
| | 800 | x | x | x | ○ |
| | 1000 | x | x | x | ○ |
| | 1200 | x | x | x | ○ |
| | 1400 | ○ | x | x | ○ |
| 5 | 400 | x | x | ○ | ○ |
| | 600 | x | x | ○ | ○ |
| | 800 | x | x | ○ | ○ |
| | 1000 | x | x | x | ○ |
| | 1200 | x | x | x | ○ |
| | 1400 | ○ | x | x | ○ |
| 8 | 400 | x | x | ○ | ○ |
| | 600 | x | x | ○ | ○ |
| | 800 | x | x | ○ | ○ |
| | 1000 | x | x | x | ○ |
| | 1200 | x | x | x | ○ |
| | 1400 | ○ | x | x | ○ |
| 10 | 400 | x | x | ○ | ○ |
| | 600 | x | x | ○ | ○ |
| | 800 | x | x | ○ | ○ |
| | 1000 | x | x | x | ○ |
| | 1200 | x | x | x | ○ |
| | 1400 | x | x | x | ○ |

As shown in Table 4, it is recognized that no condition is present that prevents the memory image by the transfer bias voltage from being generated and that permits the transfer efficiency of the toner image at the reading edge portion to exceed 75% in also the case where the sheet-like material O is an OHP sheet. This is derived from, particularly, the fact that the OHP sheet has a very high resistance, compared with the ordinary paper sheet, leading to a high appropriate transfer bias voltage. Since the appropriate transfer bias voltage is high, the defective transfer takes place in the reading edge portion unless the magnitude of the first transfer bias voltage V1 is set at a relatively high value. Needless to say, the transfer efficiency is lowered under the voltage lower than 800V, in which the memory image by the transfer bias voltage is not generated, so as to deteriorate the image quality. It follows that it is impossible to find the condition that prevents the memory image by the transfer bias voltage from being generated and permits the transferred toner image quality to be satisfactory even by any of the transfer bias controls described previously.

Under the circumstances, in Example 4, if the OHP key 72 of the control panel 71 of the printer apparatus 101 shown in FIG. 1 is depressed, alternatively, if the image data supplied from the outside through the interface 81 and the kind of the sheet-like material O used in the printout step are designated to be an OHP sheet, so as to select the OHP sheet mode, the image void region at the tip is changed from 5 mm to 10 mm, and the transfer bias voltage is applied directly with the magnitude of the predetermined transfer bias voltage V2 to the void region 5 mm inside the tip of the OHP sheet.

Figure 12:
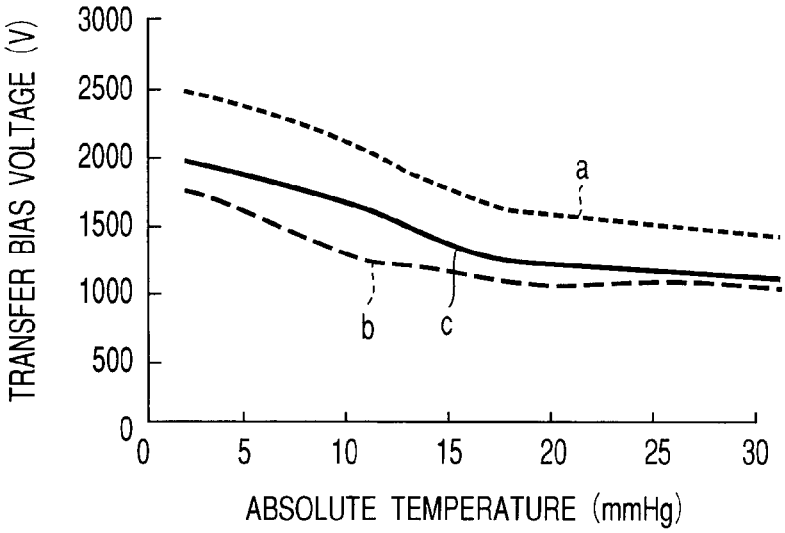
FIG. 12 is a graph showing the relationship between the magnitude of the transfer bias voltage provided by the transfer mechanism and the transfer bias voltage control method employed in the image forming apparatus shown in FIG. 1 and the absolute humidity, covering an example of controlling appropriately the transfer bias voltage in accordance with change in the environment (temperature and humidity) for the case where the sheet-like material O is a sheet for an OHP.

FIG. 12 exemplifies the control corresponding to the change in the environment (temperature and humidity) of the transfer bias voltage for the OHP sheet. In FIG. 12, curve (a) represents the upper limit of the transfer bias current, curve (b) represents the lower limit of the transfer bias current, and curve (c) represents the upper limit of the transfer bias current that does not generate the memory image by the transfer bias voltage. In this example, the timing of turning on the transfer bias voltage is determined such that the tip void amount of the OHP sheet is made broader than that of the ordinary sheet-like material O, which is a paper sheet, and the transfer bias voltage is turned on within the void, thereby suppressing the generation of the memory image by the transfer bias voltage.

It should be noted that the distance between the adjacent sheets in the step of the consecutive printout formation on a plurality of OHP sheets is shorter than the length of one complete rotation of the photosensitive drum 1 (outer circumferential length), the memory image by the transfer bias voltage generated in the trailing edge portion of the OHP sheet is caused to appear in the tip end portion of the next printout, if the printout is formed consecutively.

Table 5 shows the results of the two stage control in which the timing of turning off the transfer bias voltage is set at 5 mm outside the OHP sheet, the transfer bias voltage V2 is set at 2800V (transfer efficiency of 89%), and the current value of the transfer current is switched from I2 to I1 at the timing D' in turning off the transfer bias voltage at the trailing edge portion of the OHP sheet, as shown in FIG. 9 and the transfer current I1 is turned off a predetermined period of time later.

TABLE 5

| D2 (mm) | V1 (V) | Image quality in leading edge side of the transfer material | Solid image | Memory image by transfer bias voltage | Cleaner life |
|---|---|---|---|---|---|
| 3 | 400 | x | x | x | ○ |
| | 600 | x | x | x | ○ |
| | 800 | x | x | x | ○ |
| | 1000 | x | x | x | ○ |
| | 1200 | x | x | x | ○ |
| | 1400 | ○ | x | x | ○ |
| 5 | 400 | x | x | ○ | ○ |
| | 600 | x | x | ○ | ○ |
| | 800 | x | x | ○ | ○ |
| | 1000 | x | x | x | ○ |
| | 1200 | x | x | x | ○ |
| | 1400 | ○ | x | x | ○ |

TABLE 5-continued

| D2 (mm) | V1 (V) | Image quality in leading edge side of the transfer material | Solid image | Memory image by transfer bias voltage | Cleaner life |
|---|---|---|---|---|---|
| 8 | 400 | x | x | ○ | ○ |
| | 600 | x | x | ○ | ○ |
| | 800 | x | x | ○ | ○ |
| | 1000 | x | x | x | ○ |
| | 1200 | x | x | x | ○ |
| | 1400 | ○ | x | x | ○ |
| 10 | 400 | x | x | ○ | ○ |
| | 600 | x | x | ○ | ○ |
| | 800 | x | x | ○ | ○ |
| | 1000 | x | x | x | ○ |
| | 1200 | x | x | x | ○ |
| | 1400 | x | x | x | ○ |

As apparent from Table 5, it is recognized that, where an OHP sheet is the sheet-like material O, there is no condition (transfer bias voltage V1) under which the memory image by the transfer bias voltage is not generated and the apparatus exhibits a transfer efficiency of the toner image not lower than the allowable value at the rear portion of the sheet. Therefore, if the OHP key 72 of the control panel 71 is depressed so as to select the OHP sheet mode, or if the image data supplied from the outside through the interface 81 and the kind of the sheet-like material O in the step of the printout are designated to be an OHP sheet, the control is changed such that the image void region in the trailing edge portion of the sheet is changed from 5 mm to 10 mm, and the transfer bias voltage is directly turned off from the magnitude V2 within the void (5 mm inside the trailing edge portion of the sheet).

As described above, where an OHP sheet is the sheet-like material, the generation of the memory image by the transfer bias voltage is suppressed by making the void amount in the rear portion of the sheet larger than that for the ordinary paper sheet and by turning off the transfer bias voltage within the void. Therefore, if it is detected by depressing the OHP key 72 of the control panel 71, or by designating that the image data supplied from the outside through the interface 81 and the kind of the sheet-like material used in the printout step are for an OHP sheet, that the sheet-like material O explained in Example 4 is a resin sheet for an OHP, the generation of the memory image by the transfer bias voltage is suppressed by changing lengths of the image void regions both in the reading edge portion and the trailing edge portion of the toner image, by directly applying a predetermined voltage as the transfer bias voltage, and by directly turning off the transfer bias voltage from the predetermined voltage.

EXAMPLE 5

In Example 4, where a resin sheet for an OHP constitutes the sheet-like material, the generation of the memory image by the transfer bias voltage is suppressed by increasing the length of the image void region in the front end portion or both the front end portion and the trailing edge portion. However, if the image void region is increased, the magnitude of the image region is restricted.

If the distance between the adjacent sheet-like materials O is increased in consecutively forming printouts on a plurality of sheet-like materials O in the printing on an ordinary paper sheet, the problem is generated that the substantial image forming rate is lowered. In the case of the printout on the OHP sheet, however, a high image forming rate is less required.

Under the circumstances, where the OHP key 72 of the control panel 71 is depressed so as to select the OHP sheet mode, or if the image data supplied from the outside through the interface 81 and the kind of the sheet-like material O in the step of the printout are designated to be an OHP sheet, the memory image by the transfer bias voltage in the trailing edge portion of the OHP sheet does not enter the image region of the next printout by changing the distance for every page information when the image data to the photosensitive drum is exposed to light by the light exposure device 5, i.e., the distance for every repetition in the case where the same data are repeatedly exposed to light, from the ordinary distance of 100 mm to, for example, 140 mm. Therefore, the generation of the memory image by the transfer bias voltage is prevented with the magnitude of the image void region in the trailing edge portion of the sheet left to be 5 mm. Also, in this case, the transfer bias voltage need be controlled in two stages. Incidentally, in this case, the item to be controlled or changed in addition to the timing of exposing the image data from the light exposure device 5 to the light is only the time interval for rotating the registration roller motor 11. It follows that the load to the main control board 51 of the printer apparatus 101 is small.

Therefore, if the timing of turning off the transfer bias voltage at the trailing edge portion of the OHP sheet is set at a point within 25.7 mm (=140−40 $\pi$) from the trailing edge portion of the OHP sheet, it is possible to prevent the defective image (dropout of transfer) at the trailing edge portion of the OHP sheet. Also, the memory image by the transfer bias voltage is not generated in spite of the consecutive printout formation.

The OHP sheet is taken up as an example of the sheet-like material O in Example 5. However, it is also possible to obtain a satisfactory printout in which the memory image by the transfer bias voltage is not generated even in the case of the printout on a thick paper sheet having a thickness exceeding 120 g/m$^2$ by setting the distance between the adjacent sheet-like materials O (thick paper sheets) at 140 mm in the consecutive printout operation and by controlling the transfer bias voltage in two stages in the rear portion of the thick paper sheet.

EXAMPLE 6

In Example 5, the distance between the adjacent sheet-like materials O is made larger than that in the case of using the ordinary paper sheet, i.e., change from 100 mm to 140 mm, without changing the transfer bias voltage in two stages in the case where an OHP sheet or a thick sheet having a thickness exceeding 120 g/m$^2$ is used as the sheet-like material O. It should be noted that, in the case of forming a printout on an OHP sheet, a high speed image formation is not required, compared with the case where a printout is formed on the ordinary paper sheet. Therefore, where the OHP sheet is selected, it is possible to suppress the generation of unevenness in the transfer timing of the sheet-like material O without lowering the image forming speed (process speed) in forming a printout as shown in Table 6. It follows that it is impossible to turn the transfer bias voltage on or off within the image void region, making it unnecessary to control the transfer bias voltage in two stages.

TABLE 6

| Process speed | Probability (%) of turning transfer bias voltage on within void |
|---|---|
| 40 | 100 |
| 60 | 100 |
| 80 | 99.4 |
| 100 | 99.1 |
| 120 | 96.2 |
| 140 | 90.5 |
| 160 | 82.2 |
| 180 | 72 |
| 200 | 55 |

Table 6 show the process speed (image forming speed) and the probability of turning on the transfer bias voltage within the tip void region of the sheet-like material O. If the process speed is not higher than 120 mm/sec, the transfer bias voltage can be turned on within the tip void region with a probability of 99%. Incidentally, in order to change the process speed, a signal indicating that the kind of the sheet-like material O is an OHP sheet or a thick paper sheet having a thickness not smaller than 120 g/m$^2$ is supplied from the control panel 71 to the main control board 51 in the printer apparatus shown in FIG. 1. In accordance with the instruction given from the main control board 51, the rotating speed of each of the drum motor 7 for rotating the motor driver 52 and the photosensitive drum 1, the belt motor 8 for rotating the driving roller 2*a* having the transfer belt 2 stretched about it, the registration roller motor 11 for rotating the registration roller 10 and the fixing motor 14 for rotating the heating roller 13*a* of the fixing device 13 is changed to conform with the rotation speed stored in the first LUT (LUT1) 61, thereby easily changing the process speed. It is also possible to change the charging voltage supplied from the charging device 4 to the photosensitive drum 1, if necessary.

As described above, upon receipt of an instruction that the sheet-like material O is an OHP sheet or a thick paper sheet having a thickness exceeding 120 g/m$^2$, it is possible to turn on or off the transfer bias voltage within the void region in each of the front end portion and the trailing edge portion of the sheet-like material O without employing the two stage control of the transfer bias voltage by changing the process speed from 175 mm/sec to, for example, 100 mm/sec. Therefore, it is possible to carry out a satisfactory toner image transfer, which does not form a defective toner image, with a high transfer efficiency without giving rise to a memory image by the transfer bias voltage.

As described above, in the image forming apparatus of the present invention, a transfer bias voltage having an intermediate magnitude, which does not give rise to a memory image by the transfer bias voltage, is applied to the reading edge portion of the sheet-like material O, and the sheet-like material O is transferred. As a result, it is possible to obtain the toner image transfer performance that does not give rise to any practical problem in the image in the reading edge portion of the sheet-like material O without giving rise to a memory image by the transfer bias voltage by the switching to a predetermined transfer bias voltage at the time when the photosensitive drum is rotated to reach the state of not being exposed to the transfer bias voltage.

It should also be noted that it is possible to obtain a toner image transfer performance that does not give rise to the memory image by the transfer bias voltage and that does not produce any practical problem in the image in the rear portion of the sheet-like material O by turning off the transfer bias voltage after the voltage is switched to a transfer bias voltage having an intermediate magnitude that does not give rise to the memory image by the transfer bias voltage in turning off the transfer bias voltage in the trailing edge portion of the sheet-like material O.

Incidentally, since the intermediate transfer bias voltage can be calculated on the basis of the magnitude of a predetermined transfer bias voltage, it is possible to decrease the required capacity of memory, leading to reduction in the cost of the image forming apparatus.

It should also be noted that, where a transparent resin sheet for an OHP constitutes the sheet-like material O, it is possible to prevent the occurrence of the memory image by the transfer bias voltage by increasing the distance between the adjacent sheet-like materials O in the step of the consecutive printout, compared with the ordinary paper sheet. Incidentally, the similar effect can also be obtained by decreasing the process speed, compared with the process speed for the ordinary paper sheet.

Further, it is possible to prevent the occurrence of the memory image by the transfer bias voltage in also the case where the sheet-like material O is a thick paper sheet having a thickness larger than 120 $g/m^2$ by increasing the distance between the adjacent sheet-like materials O, compared with the case where the ordinary paper sheet is used as the sheet-like material O. The similar effect can also be obtained by decreasing the process speed, compared with the process speed for the case where the ordinary paper sheet is used as the sheet-like material O.

What should also be noted is that the toner image quality of the printout can be further improved by reflecting the result of the detection of the change in the environment (temperature and humidity) in the control of the magnitudes of the transfer bias voltage and the transfer current in the method of controlling the transfer bias voltage.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

an image forming section for forming a toner image on an image carrier;

a transfer device that is brought into contact with the image carrier with a transfer medium interposed therebetween, for transferring the toner image formed by the image forming section onto the transfer medium;

a bias voltage supply for supplying a transfer bias voltage to the transfer device; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium, wherein, when the transfer medium is a paper sheet, said bias voltage controller switches on the bias voltage supply with a first voltage V1 when said bias voltage supply is at a position corresponding to a distal end of the transfer medium, and after a predetermined period of time, controls the bias voltage supply to output a second voltage V2, an absolute value of said second voltage V2 being greater than an absolute value of said first voltage V1, said first voltage V1 is defined by V1=f(V2) where f is a function, and said function is defined based on at least one of a thickness and a type of said transfer medium.

2. An image forming apparatus according to claim 1, wherein said transfer medium includes a transparent resin sheet for overhead projectors.

3. An image forming apparatus, comprising:

an image forming section for forming a toner image on an image carrier;

a transfer device that is brought into contact with the image carrier with a transfer medium interposed therebetween, said transfer medium including at least one of paper sheets and sheet-like resins, for transferring the toner image formed by the image forming section onto the transfer medium;

a bias voltage supply for supplying a transfer bias voltage to the transfer device;

a device for changing the transfer interval of the transfer media for changing the timing of guiding the transfer media toward the image forming section; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium.

4. An image forming apparatus according to claim 3, wherein, when the transfer medium is a paper sheet, said bias voltage controller switches on the bias voltage supply with a first voltage V1 when said bias voltage supply is at a position corresponding to a distal end of the transfer medium, and after a predetermined period of time, controls the bias voltage supply to output a second voltage V2, an absolute value of said second voltage V2 being greater than an absolute value of said first voltage V1, said first voltage V1 is defined by V1=f(V2) where f is a function, and said function is defined based on at least one of a thickness and a type of said transfer medium.

5. An image forming apparatus according to claim 3 wherein, when the transfer medium is a paper sheet and the toner image is formed by the image forming section on said paper sheet, said bias voltage controller switches on the bias voltage supply with a first current I1 that provides a first voltage V1 when said bias voltage supply is at a position corresponding to a distal end of the transfer medium, and after a predetermined period of time, controls the bias voltage supply to output a second current I2 that provides a second voltage V2, an absolute value of said second voltage 2 being greater than an absolute value of said first voltage V1.

6. An image forming apparatus according to claim 3, wherein, when the transfer medium is a paper sheet and the toner image is formed by the image forming section on said paper sheet, said bias voltage controller switches on the bias voltage supply with a first voltage V1 when said bias voltage supply is at a position corresponding to a distal end of the transfer medium, and after a predetermined period of time, controls the bias voltage supply to output a second voltage V2, an absolute value of said second voltage V2 being greater than an absolute value of said first voltage V1, said first voltage V1 is defined by V1=f(V2) where f is a function, and said function is defined based on at least one of a thickness and a type of said transfer medium.

7. An image forming apparatus according to claim 3, wherein, when said toner image is formed by the image forming section on a number of transfer mediums each of which is identical to said transfer medium, said bias voltage controller controls said bias voltage supply to output a same predetermined voltage at a rear end of each of said number of transfer mediums after said bias voltage controller controls said bias voltage supply to output a second voltage V2 at a position a predetermined distance away from the rear end of said each of said number of transfer mediums, an absolute value of said second voltage V2 being less than an absolute value of said first voltage V1, said first voltage V1 is defined by V1=f(V2) where f is a function, and said function is defined based on at least one of a thickness and a type of said transfer medium.

8. An image forming apparatus, comprising:

an image forming section for forming a toner image on an image carrier;

a transfer device that is brought into contact with the image carrier with a transfer medium interposed therebetween, for transferring the toner image onto the transfer medium;

a bias voltage supply for supplying a transfer bias voltage to the transfer device; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium, wherein, when the transfer medium is a paper sheet and the toner image is formed by the image forming section on said paper sheet, said bias voltage controller switches on the bias voltage supply with a first current I1 that provides a first voltage V1 when said bias voltage supply is at a position corresponding to a distal end of the transfer medium, and after a predetermined period of time, controls the bias voltage supply to output a second current I2 that provides a second voltage V2, an absolute value of said second voltage V2 being greater than an absolute value of said first voltage V1.

9. An image forming apparatus according to claim 8, wherein said transfer medium includes a transparent resin sheet for overhead projectors.

10. An image forming apparatus, comprising:

an image forming section for forming a toner image on an image carrier;

a transfer device that is brought into contact with the image carrier with a transfer medium interposed therebetween, said transfer medium including at least one of paper sheets and sheet-like resins, for transferring the toner image formed by the image forming section onto the transfer medium;

a bias voltage supply for supplying a transfer bias voltage to the transfer device;

an environmental state detecting device for detecting at least one of temperature and humidity in the vicinity of the image forming section; and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium, the kind of the transfer medium and the environmental condition detected by the environmental state detecting device.

11. An image forming apparatus, comprising:

an image forming section for forming a toner image on an image carrier;

a transfer device that is brought into contact with the image carrier with a transfer medium interposed therebetween, for transferring the toner image formed by the image forming section onto the transfer medium;

a bias voltage supply for supplying a transfer bias voltage to the transfer device, and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium, wherein, when the transfer medium is a paper sheet and the toner image is formed by the image forming section on said paper sheet, said bias voltage controller switches on the bias voltage supply with a first voltage V1 when said bias voltage supply is at a position corresponding to a distal end of the transfer medium, and after a predetermined period of time, controls the bias voltage supply to output a second voltage V2, an absolute value of said second voltage V2 being greater than an absolute value of said first voltage V1, said first voltage V1 is defined by V1=f(V2) where f is a function, and said function is defined based on at least one of a thickness and a type of said transfer medium.

12. An image forming apparatus according to claim 11, wherein said transfer medium includes a transparent resin sheet for overhead projectors.

13. An image forming apparatus, comprising:

an image forming section for forming a toner image on an image carrier;

a transfer device that is brought into contact with the image carrier with a transfer medium interposed therebetween, for transferring the toner image formed by the image forming section onto the transfer medium;

a bias voltage supply for supplying a transfer bias voltage to the transfer device, and a bias voltage controller for switching the on-off state of the bias voltage output from the bias voltage supply and the magnitude and polarity of the bias voltage into a predetermined magnitude and polarity at a predetermined timing in accordance with the presence and absence of the transfer medium, wherein, when said toner image is formed by the image forming section on a number of transfer mediums each of which is identical to said transfer medium, said bias voltage controller controls said bias voltage supply to output a same predetermined voltage at a rear end of each of said number of transfer mediums after said bias voltage controller controls said bias voltage supply to output a second voltage V2 at a position a predetermined distance away from the rear end of said each of said number of transfer mediums, an absolute value of said second voltage V2 being less than an absolute value of said first voltage V1, said first voltage V1 is defined by V1=f(V2) where f is a function, and said function is defined based on at least one of a thickness and a type of said transfer medium.

14. An image forming apparatus according to claim 13, wherein said transfer medium includes a transparent resin sheet for overhead projectors.

* * * * *